US006940233B2

(12) United States Patent
Gray

(10) Patent No.: US 6,940,233 B2
(45) Date of Patent: Sep. 6, 2005

(54) METHOD AND SYSTEM OF DRIVING A CCFL

(75) Inventor: Richard L. Gray, Saratoga, CA (US)

(73) Assignee: Analog Microelectronics, Inc., Santa Clara, CA (US)

( * ) Notice: Subject to any disclaimer, the term of this patent is extended or adjusted under 35 U.S.C. 154(b) by 83 days.

(21) Appl. No.: 10/264,438

(22) Filed: Oct. 3, 2002

(65) Prior Publication Data

US 2004/0066149 A1 Apr. 8, 2004

(51) Int. Cl.[7] ..... H05B 37/00
(52) U.S. Cl. ..... 315/276; 315/277; 315/278
(58) Field of Search ..... 315/246, 247, 315/224, 276, 277, 278

(56) References Cited

U.S. PATENT DOCUMENTS 4,378,515 A * 3/1983 Nakai et al. ..... 315/290
5,615,093 A 3/1997 Nalbant
5,619,402 A 4/1997 Liu
5,652,479 A 7/1997 LoCascio et al.
5,754,012 A 5/1998 LoCascio et al.
5,844,378 A 12/1998 LoCascio et al.
5,923,129 A 7/1999 Henry
5,930,121 A 7/1999 Henry
6,094,015 A * 7/2000 Wessels et al. ..... 315/291
6,114,814 A 9/2000 Shannon et al.
6,316,881 B1 11/2001 Shannon et al.

* cited by examiner

*Primary Examiner*—David Vu
(74) *Attorney, Agent, or Firm*—Bever, Hoffman & Harms, LLP; Jeanette S. Harms

(57) ABSTRACT

To efficiently and cost-effectively produce a light source, a CCFL circuit can include a PMOS transistor, first and second NMOS transistors, and a high turns ratio transformer. The transformer can include a primary coil having a center tap, thereby forming first and second primary windings, as well as a secondary coil. The PMOS transistor can be connected to the center tap for driving the transformer. The first and second NMOS transistors can be connected to the first and second primary windings, respectively. Of importance, the first primary winding is tightly coupled to the second primary winding, whereas the first and second primary windings are loosely coupled to the secondary coil.

28 Claims, 20 Drawing Sheets

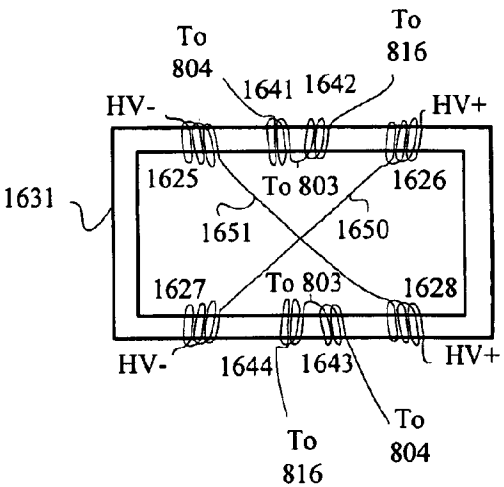
Figure 16F
Figure 16G
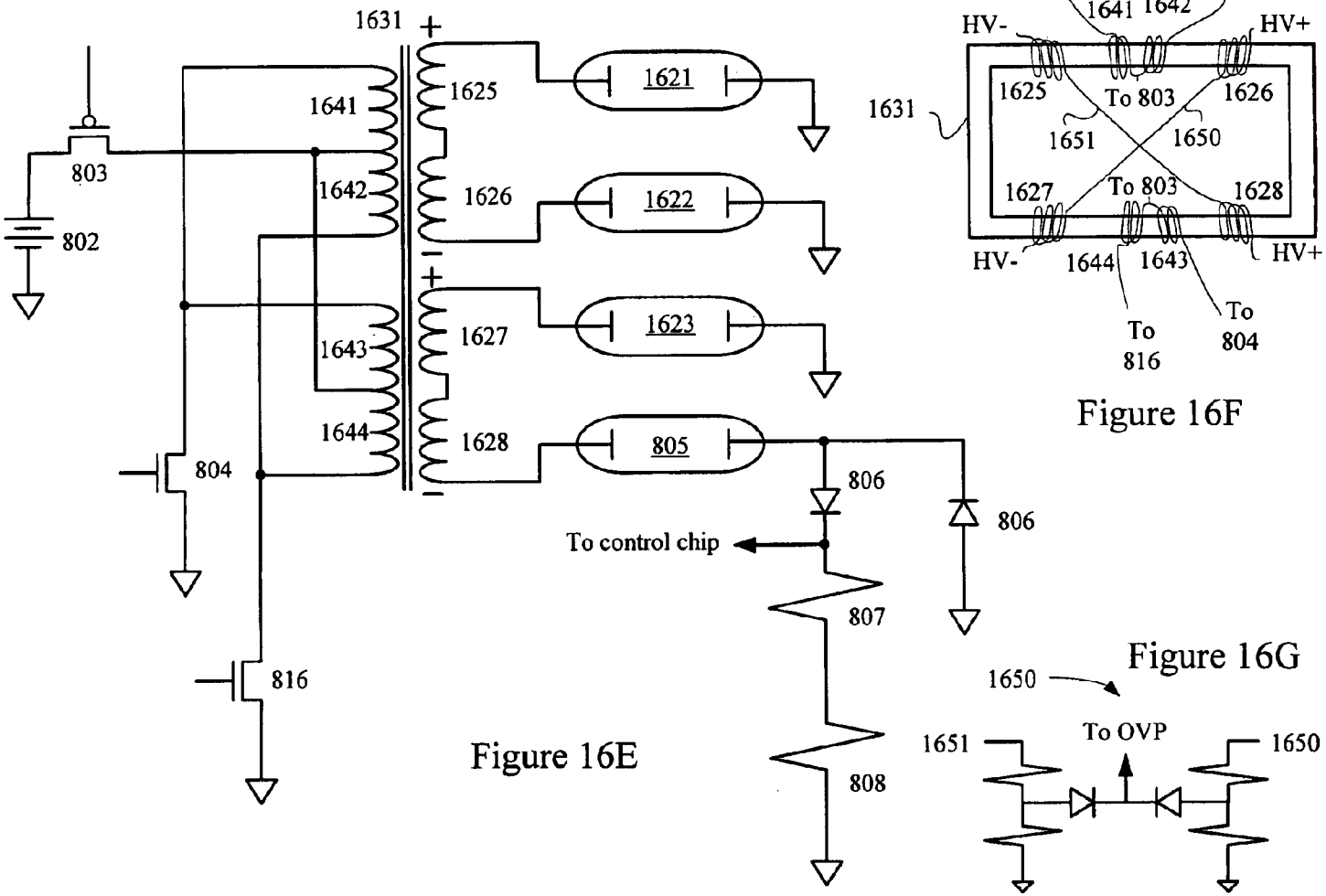
Figure 16E

METHOD AND SYSTEM OF DRIVING A CCFL

BACKGROUND OF THE INVENTION

1. Field of the Invention

The invention relates to driving a CCFL (cold cathode fluorescent lamp) with a high voltage sine wave to produce an efficient and cost effective light source. This light source can be used for backlighting in applications including, but not limited to, a notebook computer, a flat panel display, and a personal digital assistant (PDA).

2. Discussion of the Related Art

Fluorescent lamps are being used in an increasing number of applications. These applications include backlighting for many consumer products including, for example, notebook computers, flat panel displays, and personal digital assistants (PDAs). One common type of fluorescent lamp is a cold cathode fluorescent lamp (CCFL). A CCFL tube contains a gas, which is ionized to generate the desired light for the application.

During standard operation, CCFL tubes typically require a sine wave of 600 V and run at a current of several milliamps. However, the starting (or striking) voltage of the CCFL tube, which is used to ionize its contained gas, can be as high as 2000 V. At start up, the CCFL tube looks like an open circuit, i.e. the impedance of the CCFL tube prevents any current. However, after the gas is ionized, the impedance drops and current starts to flow in the CCFL tube.

In typical embodiments, the CCFL tube is driven by a high Q circuit, wherein Q refers to the quality of the circuit and is measured by the inductive or capacitive reactance of the circuit at resonance divided by the resistance. This high Q circuit generally includes additional capacitors and inductors, which undesirably increase the number of components in the system. Therefore, a need arises for a CCFL circuit that minimizes the number of additional components while still achieving an efficiency of at least 85%.

SUMMARY OF THE INVENTION

In accordance with one feature of the invention, a CCFL circuit can include a PMOS transistor, first and second NMOS transistors, and a high turns ratio transformer. The transformer can include a primary coil having a center tap, thereby forming first and second primary windings, as well as a single secondary coil. The drain of the PMOS transistor can be connected to the center tap and the source of the PMOS transistor can be connected to a battery. The drains of the first and second NMOS transistors can be connected to the ends of the first and second primary windings, respectively. The sources of the first and second NMOS transistors can be connected to a voltage source VSS, Of importance, the first primary winding is tightly coupled to the second primary winding. However, the first and second primary windings are loosely coupled to the secondary coil, thereby resulting in significant leakage inductance. Specifically, this loose coupling results in significant leakage inductance, which can be modeled as a series inductance in the secondary coil. In one embodiment, the primary to secondary turns ratio is approximately 100 and the primary inductance is approximately 200 uH.

Due to the leakage inductances of the transformer, voltages at the drains of the first and second NMOS transistors can potentially ring to values substantially higher than the ideal value (e.g. twice times the battery voltage). To limit the extent of the ringing voltage, the CCFL system can include a snubbing circuit connected to the drains of the NMOS transistors, the source of the PMOS transistor, and the first and second primary windings.

The snubbing circuit can include first and second diodes, a capacitor, and a resistor. In one embodiment, an input terminal of the first diode can be connected to an end of the first primary winding, an input terminal of the second diode can be connected to the end of the second primary winding, and output terminals of the first and second diodes can be connected to a common node. A resistor and a capacitor can be connected in parallel between the common node and the battery.

In the snubbing circuit, the capacitor, resistor, and diodes are configured to maintain a nominal voltage at the common node. In one embodiment, this nominal voltage is approximately twice the battery voltage. However, if either of the drains of the first and second NMOS transistors have a voltage above that nominal voltage, then the first and second diodes forward bias and allow the ringing energy to charge the capacitor. The resistor can bleed off the extra ringing energy, thereby preventing the voltage at the common node from increasing substantially higher than the nominal voltage.

In accordance with another feature of the invention, a detection circuit for detecting over-voltages in a CCFL circuit is provided. Of importance, the resistive and capacitive components of the detection circuit are isolated from the high voltage terminal of CCFL tube. Having resistive and capacitive components exposed to such a high voltage can undesirably reduce current and energy through such components, thereby reducing efficiency.

The detection circuit can include an integrator receiving an output signal of the CCFL circuit. The integrator generates a DC signal COMP such that a time-averaged voltage of the output signal from the CCFL circuit is substantially equal to a reference voltage. Advantageously, the COMP signal does not experience high voltages and typically does not vary significantly during normal circuit operation. For example, even during dimming cycles, the rise and fall of the COMP signal are smooth and relatively noise free. However, if arcing occurs, then the COMP signal becomes erratic as the circuit fights to stay in regulation.

The detector circuit can further include a first capacitor having a first terminal connected to an output of the integrator, a first diode having an input terminal connected to a second terminal of the first capacitor, and a second diode having an output terminal connected to the second terminal of the first capacitor. The detector circuit can further include a pnp transistor having a base connected to an output terminal of the first diode, an emitter connected to an input terminal of the second diode, and a collector connected to a voltage source VSS. A first resistor can be connected between the output terminal of the first diode and the voltage source VSS. A second capacitor can be connected between the output terminal of the first diode and the voltage source VSS. A second resistor can be connected between the source of the NPN transistor and a voltage source VDD. In this configuration, the emitter of the pnp transistor can provide a signal indicating whether an over-voltage condition occurs in the CCFL circuit. In one embodiment, the second capacitor and the second resistor establish a time constant for a trigger transition period of the output signal of the CCFL circuit.

In accordance with another feature of the invention, a method of detecting an over-voltage condition in a CCFL circuit is provided. The method can include providing a transistor configured for generating a detect signal indicative of the over-voltage condition. The transistor can be isolated from the CCFL circuit using an integrator. A first circuit can be provided for pumping up a voltage at a base of the pnp transistor. A second circuit can be provided for leaking the voltage at the base of the pnp transistor. If an output signal of the integrator is moving erratically, then the pumping can overcome the leaking, thereby increasing a voltage at a drive terminal of the transistor as well as the detect signal. In one embodiment, the method can further include establishing a time constant for a trigger transition period of the output signal of the CCFL circuit.

In accordance with another feature of the invention, another detection circuit for detecting an over-voltage condition in a CCFL circuit is provided. The detection circuit can include a PCB trace formed within 7 to 15 mils (thousandths of an inch) of a high voltage connector of the CCFL circuit. The PCB trace provides a detect signal that indicates whether the over-voltage condition exists.

In accordance with another feature of the invention, a CCFL system for driving first and second CCFL tubes is provided. The CCFL system can include a PMOS transistor, first and second NMOS transistors, and a high turns ratio transformer. The transformer includes a primary coil having a center tap forming a first primary winding and a second primary winding, and a secondary coil having a first secondary winding and a second secondary winding. In one embodiment, the drain of the PMOS transistor is connected to the center tap and the source of the PMOS transistor is connected to a battery. The drain of the first NMOS transistor is connected to an end of the first primary winding, the drain of the second NMOS transistor is connected to an end of the second primary winding, and the sources of the first and second NMOS transistors are connected to a voltage source VSS.

Of importance, the first primary winding is tightly coupled to the second primary winding, and the first and second primary windings are loosely coupled to the secondary coil, thereby resulting in significant leakage inductance. The first CCFL tube can be coupled between the first secondary winding and the voltage source VSS, whereas the second CCFL tube can be coupled between the second secondary winding and the voltage source VSS.

Advantageously, because the current through the first and second CCFL tubes is substantially equal (as long as the parasitic capacitive paths are approximately equal for both tubes), only one feedback loop connected to the first CCFL tube is necessary for determining the current through either CCFL tube.

In one embodiment, the CCFL system further includes at least a first resistor connected between the first CCFL tube and the voltage source VSS and a second resistor connected between the second CCFL tube and the voltage source VSS. The first resistor and the second resistor are sized to provide substantially equal resistances, thereby ensuring that impedances of the first and second CCFL tubes are substantially equal.

In another embodiment where the application is used to drive two CCFLs with one transformer, the secondary coil of the CCFL system includes a connection located between the first and second secondary windings. The connection is placed at approximately halfway between the first and second secondary windings. The connection provides a voltage substantially at the voltage source VSS. In contrast, the ends of the first and second secondary windings provide a large positive voltage and a large negative voltage, respectively. This connection provides a convenient method for detecting over-voltages since during normal operation it remains near VSS. If one of the CCFLs becomes open (or somewhat open) then the voltages in the secondary windings are no longer balanced and the midpoint of the two secondary windings will differ significantly from ground. This condition can be easily detected with a resistive voltage divider and a comparator. It dissipates little power since the midpoint of the two secondary windings is normally near VSS.

A CCFL system for driving first, second, third, and fourth CCFL tubes is provided. The CCFL system includes a PMOS transistor as well as first and second NMOS transistors. The CCFL system also includes a first high turns ratio transformer, which can have a first primary coil with a first center tap, thereby forming a first primary winding and a second primary winding. The first high turns transformer can also have a first secondary coil, which includes a first secondary winding and a second secondary winding. The CCFL system can further include a second high turns ratio transformer, which can have a second primary coil with a second center tap, thereby forming a third primary winding and a fourth primary winding. The second high turns ratio transformer can have a second secondary coil, which includes a third secondary winding and a fourth secondary winding.

The drain of the PMOS transistor is connected to the first and second center taps and the source of the PMOS transistor is connected to a battery. The drain of the first NMOS transistor is connected to an end of the first primary winding and an end of the third primary winding. The drain of the second NMOS transistor is connected to an end of the second primary winding and an end of the fourth primary winding. The sources of the first and second NMOS transistors are connected to a voltage source VSS.

The first primary winding is tightly coupled to the second primary winding. The third primary winding is tightly coupled to the fourth primary winding. The first and second primary windings are loosely coupled to the first secondary coil. The third and fourth primary windings are loosely coupled to the second secondary coil. The first CCFL tube is coupled between the first secondary winding and the voltage source VSS. The second CCFL tube is coupled between the second secondary winding and the voltage source VSS. The third CCFL tube is coupled between the third secondary winding and the voltage source VSS. The fourth CCFL tube is coupled between the fourth secondary winding and the voltage source VSS. The first and fourth secondary windings are connected. The second and third secondary winding are connected.

In one embodiment, the CCFL system can further include a current sensing network coupled to one of the first, second, third, and fourth CCFL tubes. In another embodiment, the CCFL system can further including a fault circuit coupled to the second secondary winding and the third secondary winding. The fault circuit can include a first resistor divider, a second resistor divider, a first diode coupled to the first resistor divider, and a second diode coupled to the second resistor divider. The first and second diodes can be connected to provide a logic OR function to fault detection circuitry.

A method of determining a fault condition for a system is provided. The system can include a transformer having a primary coil and a secondary coil, a first CCFL tube, and a second CCFL tube. The method can include creating a tap in the secondary coil, thereby forming a first secondary winding and a second secondary winding. The first CCFL tube can be connected to an end of the first secondary winding. The second CCFL tube can be connected to an end of the second secondary winding. The fault condition can be determined by sensing the voltage at the tap.

In one embodiment, determining the voltage at the tap includes dividing and rectifying the voltage. Dividing the voltage can include sizing a resistor divider so that under normal operating conditions, the rectified voltage is less than a first predetermined threshold voltage, and during a fault condition, the rectified voltage is higher than a second predetermined threshold voltage.

Another CCFL system for driving first, second, third, and fourth CCFL tubes is provided. This CCFL system also includes a PMOS transistor as well as first and second NMOS transistors. The CCFL system further includes a single high turns ratio transformer. The transformer includes a primary coil having a center tap forming a first primary winding and a second primary winding. The transformer further includes a secondary coil having a first secondary winding, a second secondary winding, a third secondary winding, and a fourth secondary winding.

The drain of the PMOS transistor is connected to the center tap and the source of the PMOS transistor is connected to a battery. The drain of the first NMOS transistor is connected to an end of the first primary winding, a drain of the second NMOS transistor is connected to an end of the second primary winding, and sources of the first and second NMOS transistors are connected to a voltage source VSS. The first primary winding is tightly coupled to the second primary winding, and the first and second primary windings are loosely coupled to the first, second, third, and fourth secondary coils.

The first CCFL tube is coupled between one end of the first secondary winding and the voltage source VSS. The second CCFL tube is coupled between one end of the second secondary winding and the voltage source VSS. The third CCFL tube is coupled between one end of the third secondary winding and the voltage source VSS. The fourth CCFL tube is coupled between one end of the fourth secondary winding and the voltage source VSS. Note that the other ends of the first and second secondary windings are connected. Similarly, the other ends of the third and fourth secondary winding are connected. As was the case with two separate transformers, the connections of the secondary windings to each other provide a convenient method for detecting over-voltage faults. In one embodiment, a current sensing network can be coupled to one of the first, second, third, and fourth CCFL tubes.

Yet another CCFL system for driving first, second, third, and fourth CCFL tubes is provided. This CCFL system also includes a PMOS transistor as well as first and second NMOS transistors. The CCFL system further includes a single high turns ratio transformer. The transformer includes a primary coil having a first center tap, thereby forming a first primary winding and a second primary winding. The transformer also includes a second center tap, thereby forming a third primary winding and a fourth primary winding. The transformer also includes a secondary coil having a first secondary winding, a second secondary winding, a third secondary winding, and a fourth secondary winding.

The drain of the PMOS transistor is connected to the first and second center taps and the source of the PMOS transistor is connected to a battery. The drain of the first NMOS transistor is connected to an end of the first primary winding and an end of the third primary winding. The drain of the second NMOS transistor is connected to an end of the second primary winding and an end of the fourth primary winding. The sources of the first and second NMOS transistors are connected to a voltage source VSS. The first primary winding is tightly coupled to the second primary winding, the third primary winding is tightly coupled to the fourth primary winding, the first and second primary windings are loosely coupled to the first and second secondary coils, and the third and fourth primary windings are loosely coupled to the third and fourth secondary windings.

In this CCFL system, the first CCFL tube is coupled between one end of the first secondary winding and the voltage source VSS, the second CCFL tube is coupled between one end of the second secondary winding and the voltage source VSS, the third CCFL tube is coupled between one end of the third secondary winding and the voltage source VSS, and the fourth CCFL tube is coupled between one end of the fourth secondary winding and the voltage source VSS. The other ends of the first and second secondary windings are connected. Similarly, the other ends of the third and fourth secondary winding are connected. As was the case earlier, the ends of the secondary windings that are connected together provide convenient means to detect over-voltage faults. The method of determining over-voltage faults in the single transformer case (4 tubes) is substantially analogous to the fault determining method of the 2 transformer case (also 4 tubes). In one embodiment, a current sensing network can be coupled to one of the first, second, third, and fourth CCFL tubes.

A method of implementing a transformer is also provided. The transformer has a middle area, a first end, and a second end. The method includes providing a low AC voltage in the middle area, a first high AC voltage having a first phase at the first end, and providing a second high AC voltage having a second phase at the second end. In one embodiment, the low AC voltage is VSS. In another embodiment, the first phase is positive and the second phase is negative. The first end can include a first winding and a second winding providing first in-phase outputs, whereas the second end can include a third winding and a fourth winding providing second in-phase outputs. Of importance, the phase of the first in-phase outputs is out of phase with the second in-phase outputs.

BRIEF DESCRIPTION OF THE FIGURES

FIG. 16E illustrates yet another embodiment in which two split primary coils as well as multiple secondary coils can be formed on one transformer core.

FIG. 16F illustrates an exemplary physical implementation of the schematic shown in FIG. 16E.

FIG. 16G illustrates a method for detecting over-voltage faults on a transformer with four secondary windings.

DETAILED DESCRIPTION OF THE FIGURES

Figure 1:
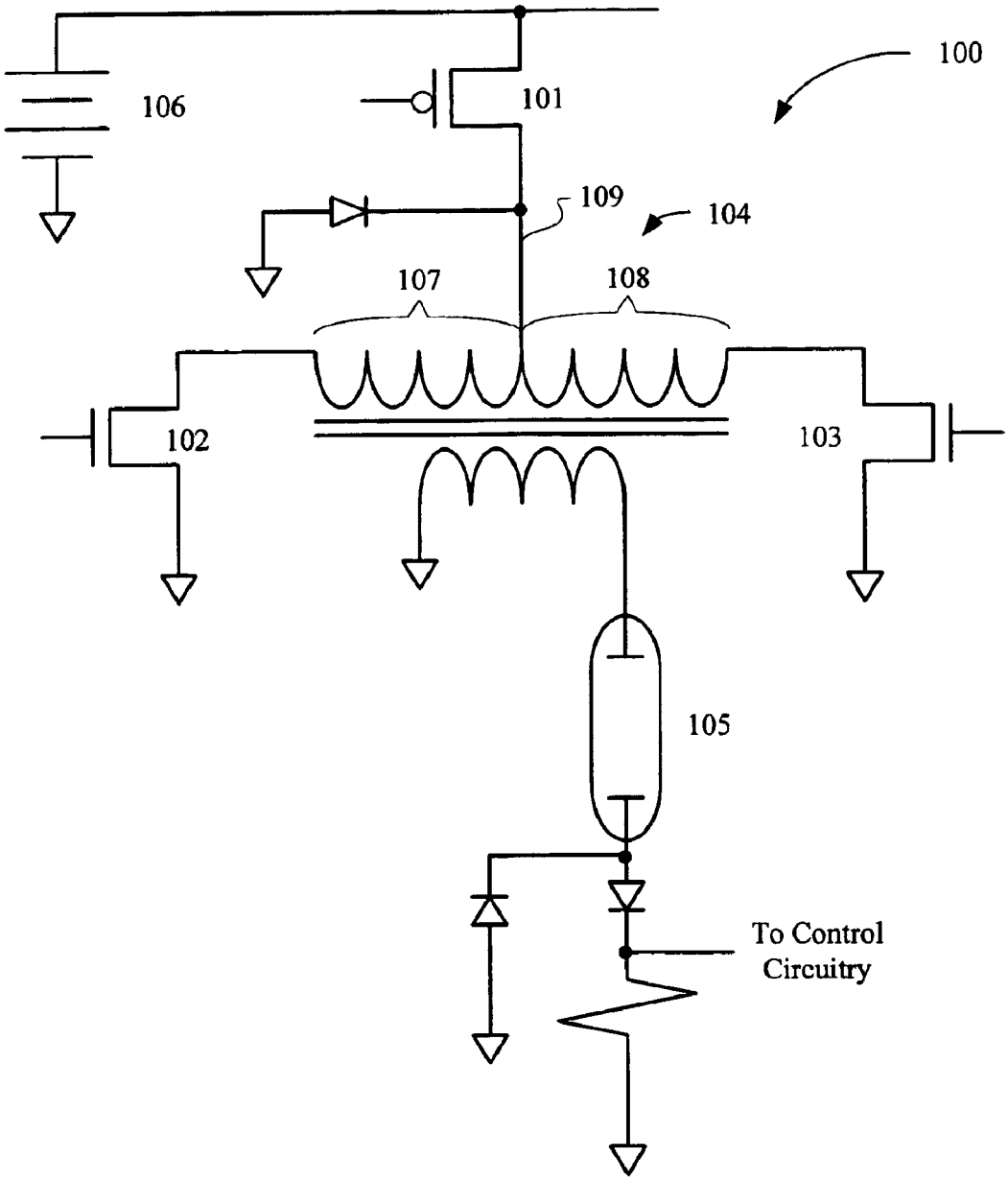
FIG. 1 illustrates a CCFL circuit including an external PMOS transistor, two external NMOS transistors, and a high turns ratio transformer with a center-tapped primary coil and a single secondary coil.

In accordance with one feature of the invention, the high voltage required for CCFL operation can be generated using a transformer-LC tank circuit combination driven by several small power mosfets. For example, FIG. 1 illustrates a CCFL circuit 100 including an external PMOS transistor 101, two external NMOS transistors 102 and 103, and a high turns ratio transformer 104 with a center-tapped primary coil and a single secondary coil. Each primary winding is tightly coupled to the other primary winding, yet loosely coupled to the secondary. This loose coupling results in significant leakage inductance, which can be modeled as a series inductance in the secondary. The primary to secondary turns ratio is approximately 100. Typical values of primary inductance are 200 uH.

Figure 2:
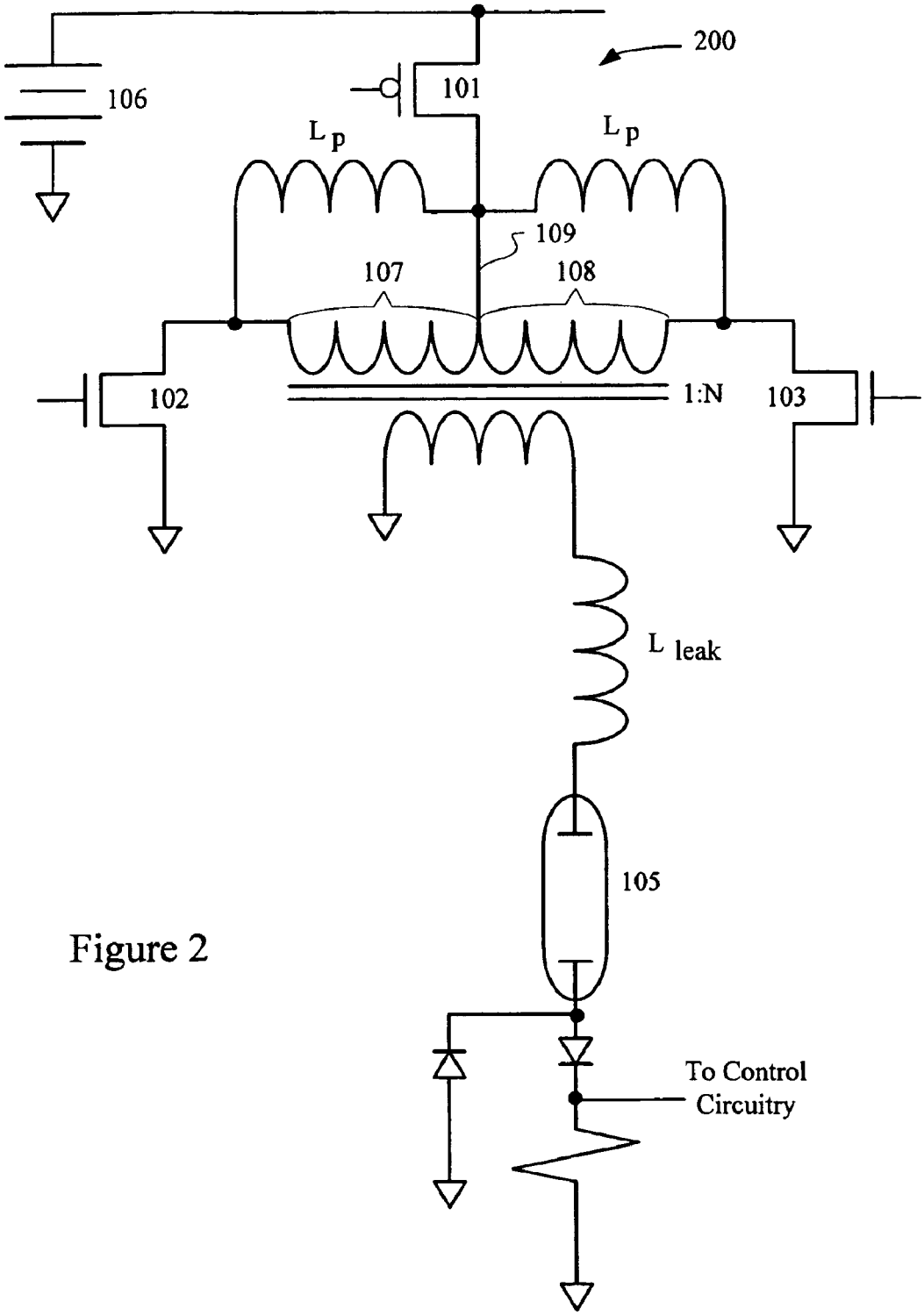
FIG. 2 illustrates a small signal model of the transformer of FIG. 1.

FIG. 2 illustrates a small signal model 200 of transformer 104, wherein model 200 includes a primary inductance $L_p$, a turns ratio 1:N, and a leakage inductance $L_{leak}$ and a parasitic parallel capacitance across the secondary $C_{parallel}$. In accordance with one feature of the invention, this leakage inductance can be advantageously enhanced to resonate with a small capacitance (e.g. a parasitic capacitance, $C_{parallel}$), thereby eliminating the need for extra prior art components (such as inductors and/or capacitors) connected to the primary winding of the transformer.

Figure 3:
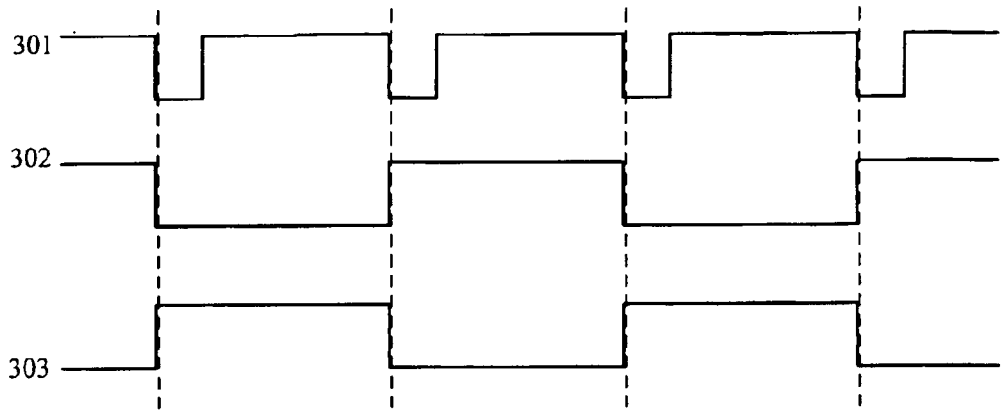
FIG. 3 illustrates idealized gate drive waveforms of the CCFL circuit of FIG. 1.

FIG. 3 illustrates idealized gate drive waveforms of CCFL circuit 100. Referring to FIGS. 1–3, NMOS transistors 102 and 103 are driven out of phase with a 50% duty cycle signal as indicated by waveforms 302 and 303, respectively. The frequency of the NMOS drive signals will be the frequency at which a CCFL tube 105 is driven. PMOS transistor 101 is driven with a pulse width modulated signal (PWM) at twice the frequency of the NMOS 102/103 drive signal. In this case, when NMOS transistor 102 and PMOS transistor 101 are on then NMOS transistor 103 is off, side 107 of the primary coil connected to NMOS transistor 102 is driven to ground and midpoint 109 is driven to the battery voltage (as provided by battery 106). In contrast, side 108 of the primary coil connected to NMOS transistor 103 is driven to twice the battery voltage. Current ramps up in side 107, thereby transferring power to the secondary coil of transformer 104. This power is stored in the leakage inductance $L_{leak}$. Note that the leakage inductance $L_{leak}$ resonates with the parasitic capacitances (not shown) in transformer 104 and the CCFL load (also not shown).

When PMOS transistor 101 is turned off, the voltage of midpoint 109 returns to ground as does the drain of NMOS transistor 103 that was at twice the battery voltage. Halfway through one cycle, NMOS transistor 102 (that was on) turns off and NMOS transistor 103 (that was off) turns on. At this point, PMOS transistor 101 turns on again, thereby allowing current to ramp up in side 108 of the primary winding. Energy in the primary winding is transferred to the secondary winding and stored again in the leakage inductance $L_{leak}$, but this time with the opposite polarity.

Thus, the duty cycle of PMOS transistor 101 controls the amount of power transferred from the primary winding to the secondary winding in transformer 104. Note that CCFL circuit 100 can work with PMOS transistor 101 on constantly (i.e. a duty cycle of 100%), although the power would be unregulated in this case.

The efficiency of CCFL circuit 100 is still high even with the addition of the second MOS transistor (i.e. either NMOS transistor 102 or NMOS transistor 103) in the current path. The I-squared losses of the extra MOS transistor are especially negligible. For instance, consider a 6W application running at 10V battery voltage. The power (P) loss for a transistor with 50 mohm resistance (R) and a drain current (I) of 600 mA is:

$$P=I\times I\times R=600\times 600\times 0.05=18\text{ mW}$$

The switching losses of NMOS transistors 102 and 103 must also be taken into account to determine the efficiency of CCFL circuit 100. However, these switching losses are hardly more significant than the I-squared losses. For example, the power loss for a transistor with a change in drain voltage (V) of 10V, a rise time (tau) of the gate drive signal of 50 nS, and a period (T) of 10 $\mu$s is:

$$P=\tfrac{1}{3}\times I\times V\times(\text{tau}/T)=\tfrac{1}{3}\times 600\times 10\times(50/10)=10\text{ mW}$$

Note that because there is no primary side capacitor, no capacitor ESR losses are incurred. Thus, when considering both I-squared and switching losses in the NMOS transistors, CCFL circuit 100 could easily achieve an efficiency of approximately 85%. However, the losses associated with transformer 104 can be significantly more than the I-squared and switching losses. Therefore, the transformer losses, discussed in more detail in reference to FIGS. 4–6, contribute to the most significant degradation in efficiency. Unfortunately, transformer losses are substantially the same for most current circuit topologies.

Figure 4:
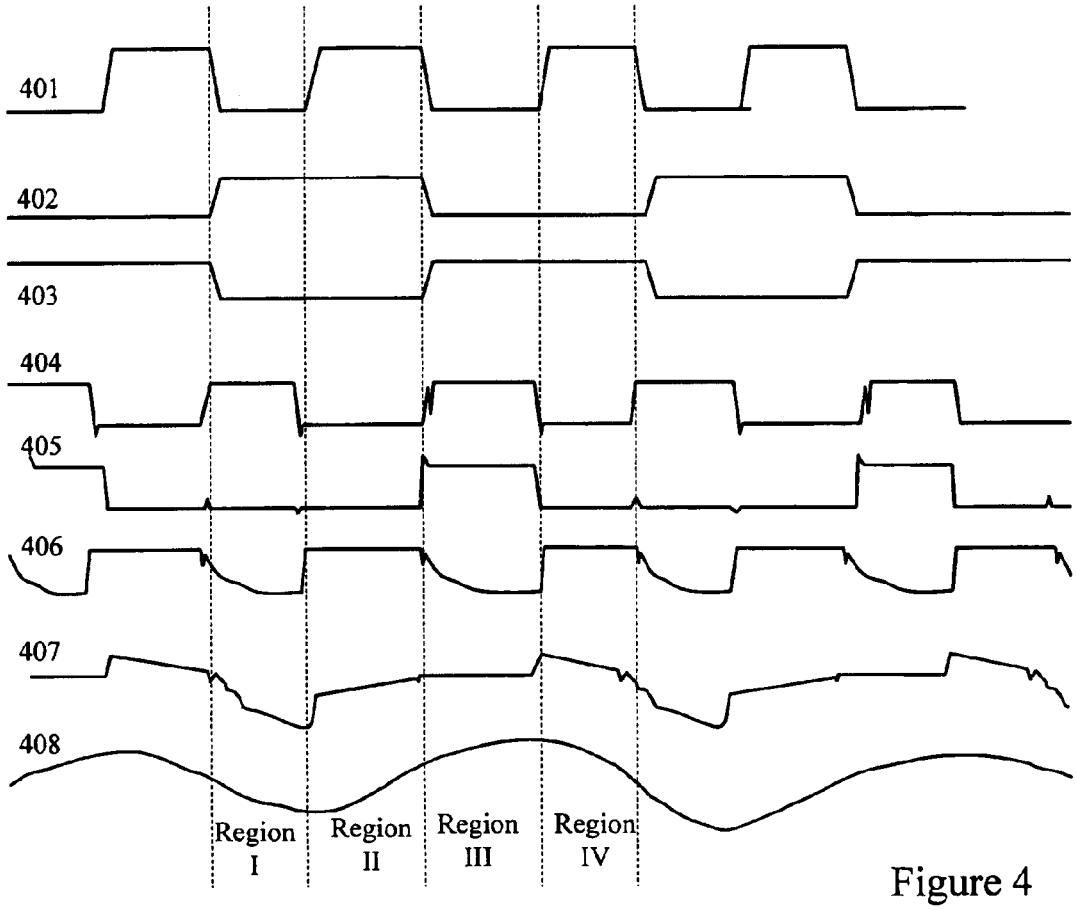
FIGS. 4, 5, and 6 illustrate various oscilloscope waveforms generated by the CCFL circuit of FIG. 1 in operation.
Figure 5:
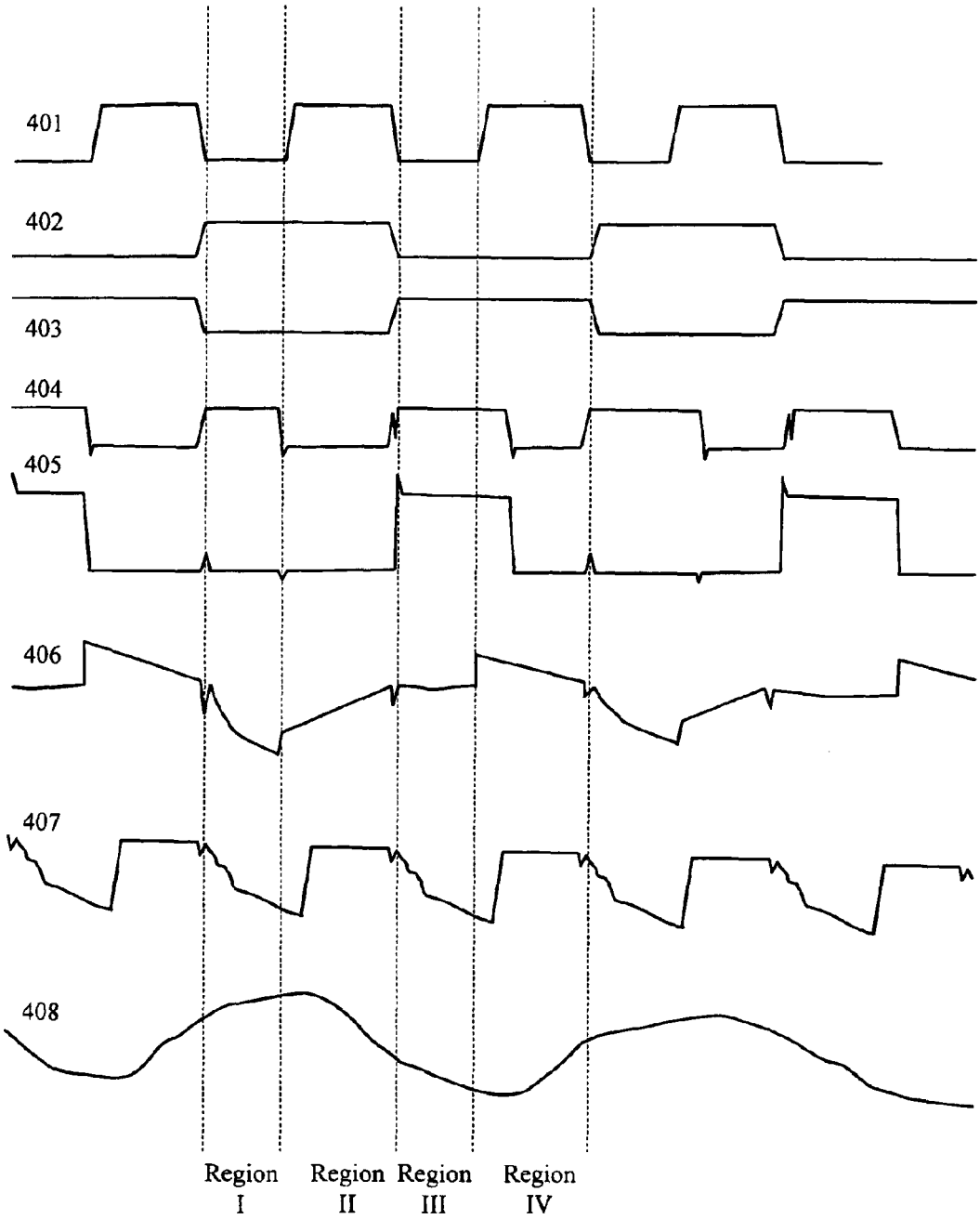
Figure 6:
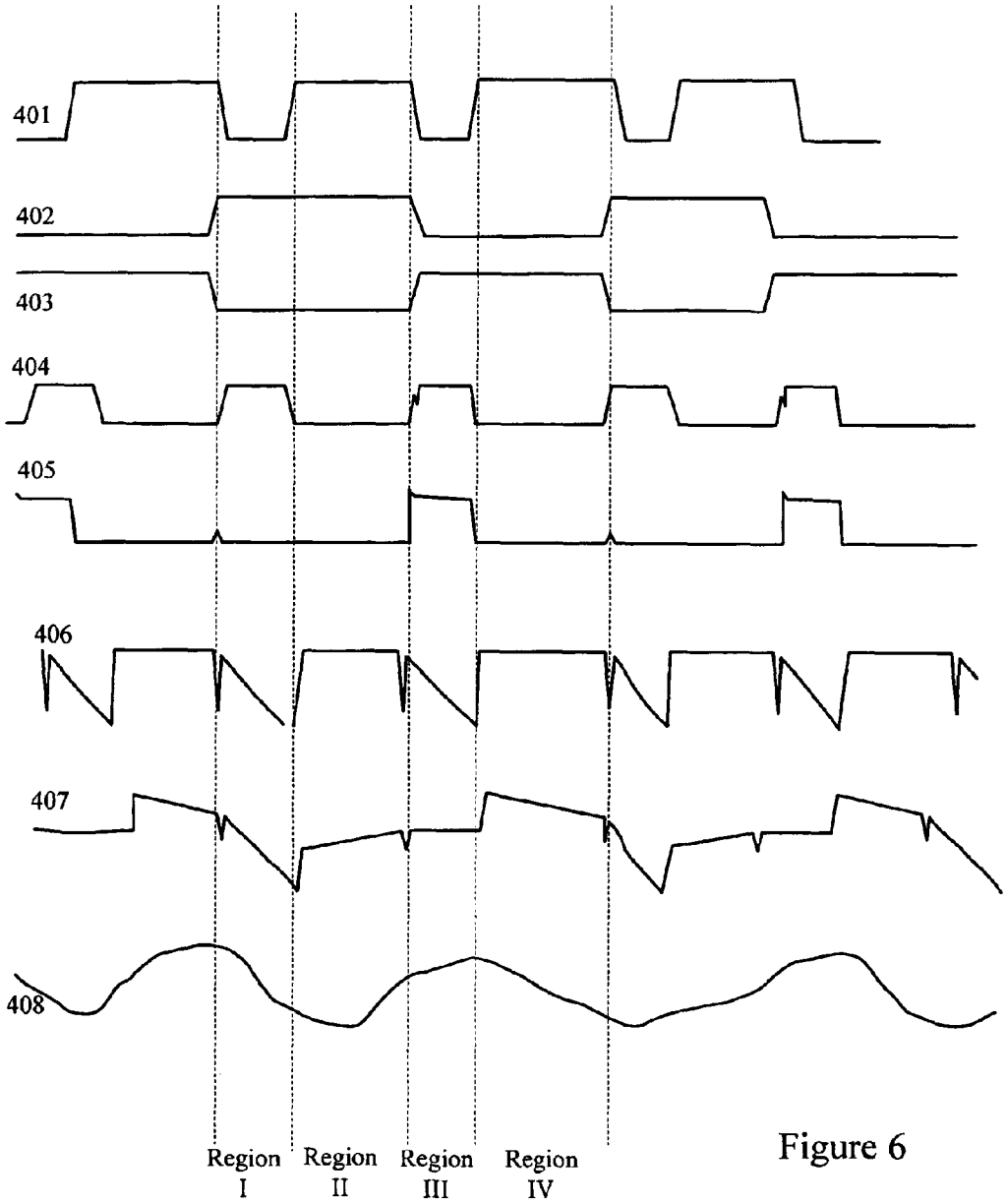

FIGS. 4, 5, and 6 illustrate various oscilloscope waveforms generated by CCFL circuit 100 in operation. Specifically, FIGS. 4, 5, and 6 illustrate generated waveforms assuming circuit operation at input (battery) voltages of 9 V, 13 V, and 21 V, respectively. These figures show that the duty cycle of the CCFL circuit steadily decreases as the battery voltage increases from 9 V to 21 V.

Traces 401, 402, and 403 in each figure show the gate drive waveforms for transistors 101, 102, and 103, respectively. In one embodiment, the gate drive waveform for transistor 101 drives up to the battery voltage but down only to approximately 7.5 V below the battery voltage. Note that in the preferred embodiment trace 401 would be driving a PMOS transistor so that the PMOS device would be "on" when trace 404 is low and "off" when trace 404 is high. The NMOS case is exactly the opposite of the PMOS case such that when trace 402 is high then its NMOS transistor is "on" and when trace 402 is low then its transistor is "off". Trace 404 (in FIGS. 4–6) shows the voltage at midpoint 109 of the primary winding (as well as the drain of PMOS transistor 101). This wave form can be characterized as essentially a ground to a battery voltage pulse of varying duty cycle. When midpoint 109 is driven high, current increases through PMOS transistor 101 as indicated in trace 406 (note that current also increases through one of the sides 107/108 (i.e. whichever side has the conducting NMOS transistor). When PMOS transistor 101 is switched off, the current through this transistor, after an initial sharp drop, ramps back down towards zero.

Trace 405 shows the voltage at the drain of NMOS transistor 102 (i.e. the voltage on the line connected to the primary winding of transformer 104) (note that the trace for NMOS transistor 103 would be identical, but shifted in time). Trace 407 shows the current through the NMOS transistor, which is equal to the current in PMOS transistor 101 for the portion of time that PMOS transistor 101 is conducting (see region I, for example). As the current ramps up in the primary winding, energy is transferred to the secondary winding and stored in the leakage inductance $L_{leak}$ (and any parasitic capacitance on the secondary winding). Note that the current in the NMOS transistor is close to zero when that NMOS transistor is turned off, thereby indicating that CCFL circuit 100 is being driven close to its resonant frequency. Although this embodiment does not sense the zero current point directly, the switching frequency could be modified such that the zero current condition was met.

Once PMOS transistor 101 completes one on/off cycle, it is repeated again with the alternate NMOS transistor conducting. This complementary operation produces a symmetric, approximately sinusoidal waveform at the input to the load (e.g. the CCFL tube 105), as shown by trace 408.

Figure 7A:
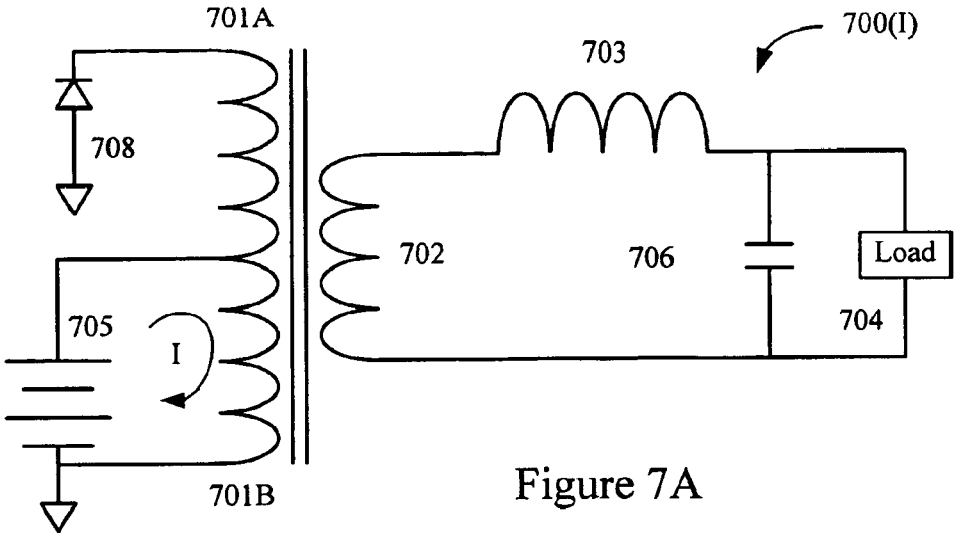
FIG. 7A shows the equivalent transformer and load circuit model for a first region of CCFL circuit operation.

The operation of CCFL circuit 100 can be divided into 4 regions (I, II, III, and IV) as shown in FIGS. 4–6. FIG. 7A shows the equivalent transformer and load circuit model 700(I) for region I. During region I, a portion 701B of the primary winding is connected across a battery 705, thereby increasing current in portion 701B and transferring energy to the secondary winding 702. The other portion 701A of the primary winding stays at twice the battery voltage, i.e. a substrate diode 708 of the NMOS transistor is reverse biased and therefore no current flows in portion 701A.

Figure 7B:
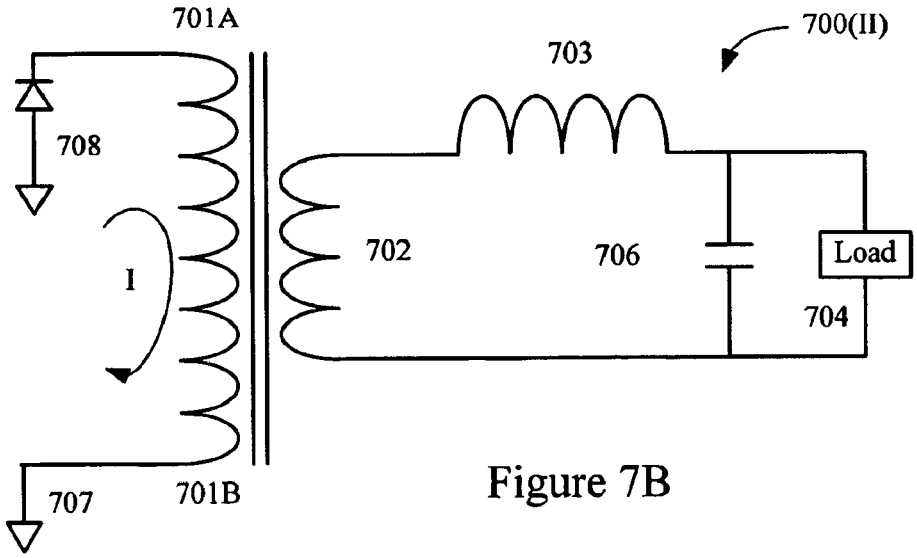
FIG. 7B shows the equivalent transformer and load circuit model for a second region of CCFL circuit operation.

FIG. 7B shows the equivalent transformer and load circuit model 700(II) for region II. During region II, battery 705 is disconnected from primary winding 701. In this configuration, current flows through both portions 701A and 701B of primary winding 701. However, the current decreases very quickly at first then ramps down to zero at a rate that is slower than the current ramped up. The initial drop is due to the effective change in leakage inductance when current flow shifts from one portion of the primary winding to both portions, thereby effectively changing the number of turns on the core.

Figure 7C:
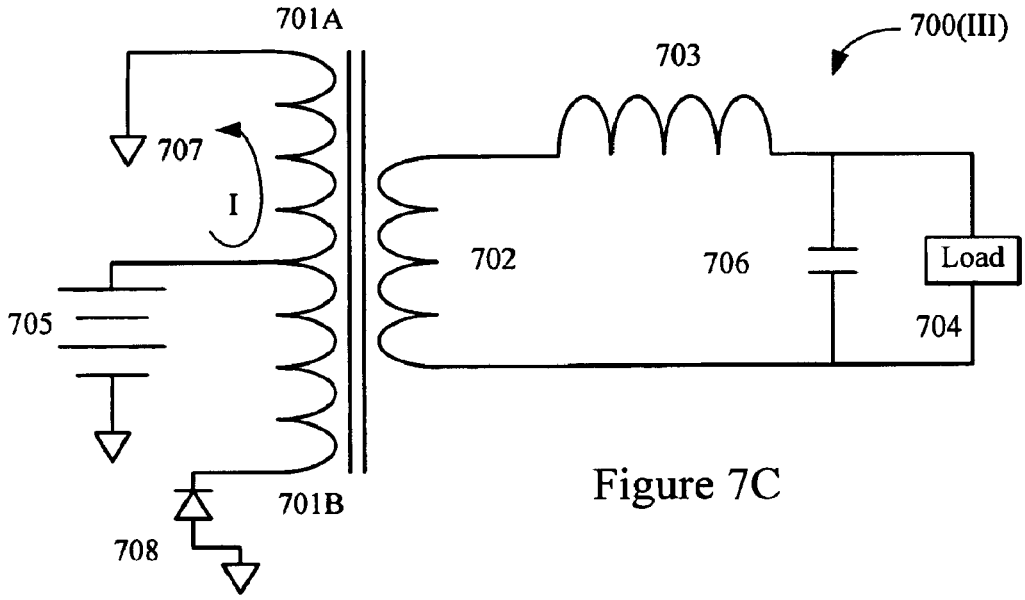
FIG. 7C shows the equivalent transformer and load circuit model for a third region of CCFL circuit operation.

FIG. 7C shows the equivalent transformer and load circuit model 700(III) for region III. During region III, portion 701A of the primary winding is connected across battery 705, thereby increasing current in portion 701A (but in a direction opposite to that of region I) and transferring energy to secondary winding 702. The other portion 701B of the primary winding stays at twice the battery voltage, i.e. a substrate diode 708 of the NMOS transistor is reverse biased and therefore no current flows in portion 701B. Therefore, region III is, effectively, the inverse of region I.

Figure 7D:
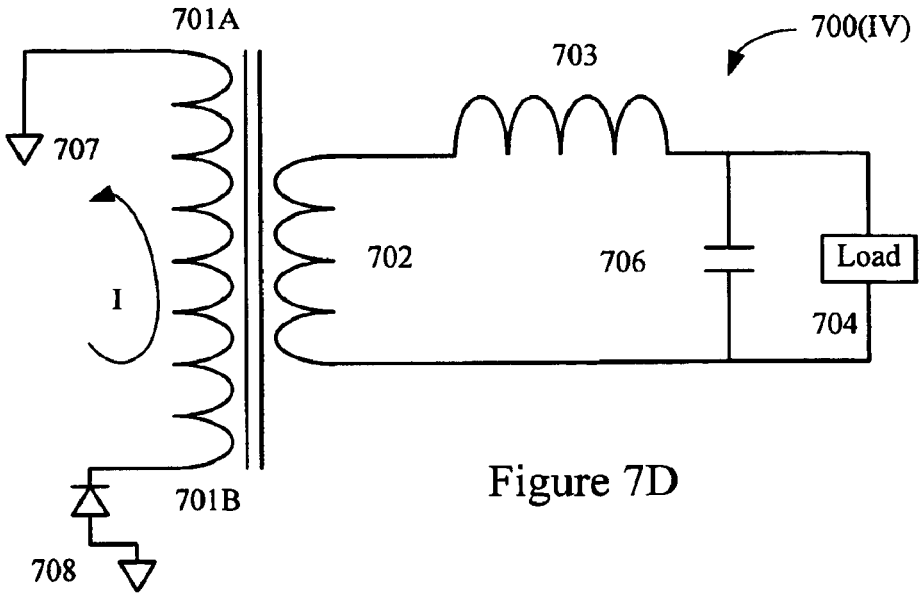
FIG. 7D shows the equivalent transformer and load circuit model for a fourth region of CCFL circuit operation.

FIG. 7D shows the equivalent transformer and load circuit model 700(IV) for region IV. During region IV, battery 705 is disconnected from primary winding 701. In this configuration, current flows through both portions 701A and 701B of primary winding 701. However, the current decreases very quickly at first then ramps down to zero at a rate that is slower than the current ramped up. Once again, the initial drop is due to the effective change in leakage inductance when current flow shifts from one portion of the primary winding to both portions, thereby effectively changing the number of turns on the core. Region IV is effectively the inverse of region II.

As the duty cycle changes with battery voltage, the overall resonant frequency might also change. For example, referring to trace 407 on FIGS. 4 and 6, the slope in region I is much steeper in FIG. 6 (i.e. 21 V operation) than in FIG. 4 (i.e. 9 V operation). This result would be expected because the voltage across the primary winding is higher. In contrast, the slope of trace 407 in regions II and IV is substantially the same between 9 V and 21 V operation. This result would also be expected because the voltages at the transformer terminals are the same for these phases regardless of the battery voltage. Note that if the traces were completely linear, then the ideal driving frequency should be the same for 9 V operation as for 21 V operation. However, as shown in region I during 9 V operation, the trace is not linear, but rather bends back toward zero current. The trace in region I during 21 V operation is strictly linear. Thus, the ideal driving frequency for 9 V operation is slower than the ideal driving frequency for the 21 V operation. Therefore, to keep the transistors switching near zero current, the switching frequency must increase with increasing battery voltage. Simply connecting a resistor between the RDELTA pin and Vbatt will increase the oscillator frequency as Vbatt increases. The resistance value of the resistor and the maximum Vbatt voltage determine the range of the oscillator frequency.

System Overview

Figure 8A:
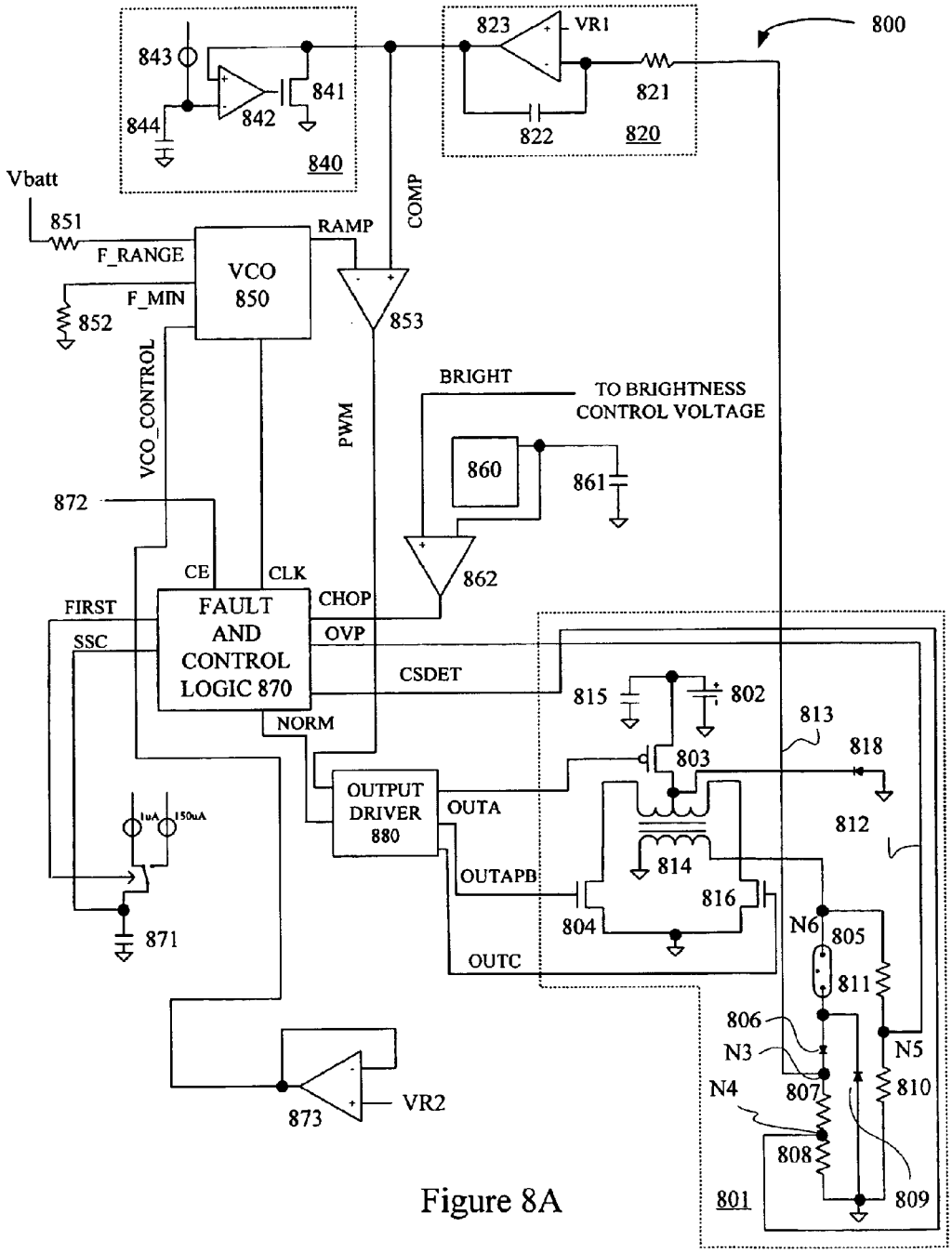
FIG. 8A illustrates a system including a CCFL circuit in accordance with the present invention.

FIG. 8A illustrates a system 800 in accordance with the present invention. System 800 includes a CCFL circuit 801, which includes the components shown in reference to CCFL circuit 101 (FIG. 1). CCFL circuit 801 and the operation of system 800 including CCFL circuit 801 will now be described in further detail. CCFL circuit 801 includes a PMOS transistor 803, which is connected between a battery voltage 802 and the midpoint of the primary winding of a transformer 814. The source of PMOS transistor 803 is further connected to a capacitor 815, which acts as an AC bypass for the battery. The drain of PMOS transistor 803 is further connected to a diode 818, which in turn is coupled to voltage VSS (e.g. ground). Diode 818 is not strictly necessary to the operation of the circuit but it is sometimes added to minimize ringing. The primary winding of transformer 814 is connected to the drains of NMOS transistors 804 and 816 (wherein the sources of NMOS transistors 804 and 816 are connected to ground). The secondary winding of transformer 814 is coupled between ground and the input terminal of a CCFL tube 805. CCFL circuit 801 further includes a diode 806 connected between the output terminal of CCFL 805 and a resistor 807 as well as a diode 809 connected between the output terminal of CCFL tube 805 and ground.

In accordance with the present invention, the current through CCFL 801 is controlled by a combination of the duty cycle of the driving waveform (i.e. the waveform that drives a transistor 803) and the frequency of that driving waveform. In one embodiment, system 800 includes a first control block connected to a node N3 that provides a DC signal COMP to a positive terminal of a comparator 853. The first control block controls the duty cycle of the driving waveform. Specifically, the first control block senses the CCFL current, integrates it against an internal reference and adjusts the duty cycle to obtain the desired power.

System 800 further includes a second control block that provides a signal RAMP (sawtooth waveform) to a negative terminal of comparator 853. The output signal of comparator 853, i.e. a PWM signal (a pulse width modulated waveform), is provided to an output driver 880, which in turn provides the clock signals OUTA, OUTAB, and OUTC to transistors 803, 804, and 816, respectively (i.e. the driving waveforms to CCFL circuit 801). The second control block can be used to change the frequency of the driving waveforms as a function of battery voltage. As the voltage of battery 802 increases, the oscillator frequency also increases. This tends to keep the circuit operating near its resonant frequency as the battery voltage changes.

System 800 further includes a third control block that adjusts the brightness of CCFL tube 805 by turning the lamp on/off at varying duty cycles. In this embodiment, a user-provided BRIGHT voltage can be compared with a slow ramp signal to generate a CHOP signal. This CHOP signal is provided to fault and control logic 870, which in turn generates a NORM signal input to output driver 880.

First Control Block

As described above, the current through CCFL 805 can be sensed on a line 813, which is coupled to node N3. In accordance with one feature of the present invention, that voltage on line 813 can drive an input of an integrator 820. Specifically, integrator 820 receives the voltage on line 813 through a resistor 821, wherein resistor 821 is coupled to the negative terminal of an error amplifier 823. In one embodiment, resistor 821 provides a resistance of 10 kOhm. Error amplifier 823 compares this voltage with a reference voltage VR1 received on its non-inverting terminal.

In one embodiment, reference voltage VR1 is derived from a temperature and supply stable reference (such as a bandgap reference) through a resistor divider. Other known techniques for providing reference voltage VR1 can also be used. In one embodiment, reference voltage VR1 can be between 0.5 V and 3.0 V. Note that the larger the reference voltage VR1, the larger the average voltage across resistor 821. In contrast, if reference voltage VR1 is too small, then error amplifier offsets and other non-idealities may become significant. Therefore, in one embodiment, reference voltage VR1 can be 2.5 V.

A capacitor 822, in one embodiment providing a capacitance of 1 uF, is coupled to the negative terminal and the output terminal of error amplifier 823, thereby completing the formation of integrator 820. The purpose of integrator 820 is to generate a DC signal COMP such that the time-averaged voltage at node N4 is substantially equal to reference voltage VR1.

Clamping circuit 840 can limit the increase of the COMP signal. In one embodiment, clamping circuit 840 includes an error amplifier 842 providing an output signal to the gate of a transistor 841. Transistor 841, an n-type transistor, has its source coupled to VSS and its drain coupled to the positive input terminal of error amplifier 842 as well as to the output of integrator 820. Error amplifier 842 further includes a negative input terminal coupled to a current source 843 and one terminal of a capacitor 844 (the other terminal being coupled to VSS). In this configuration, clamping circuit 840 allows the COMP signal to increase at a rate that is no faster than current source 843 can charge capacitor 844. Thus, clamping circuit 840 prevents the COMP signal (and thus the PWM signal) from immediately going to its full power mode, thereby allowing CCFL 805 to start up slowly. Having a gradual increase of the power to CCFL 805 advantageously prolongs its life as well as the life of other components of CCFL circuit 801.

Second Control Block

The oscillator frequency of VCO 850 determines the frequency of the drive signal at the gate of PMOS transistor 803. In this embodiment, the user can set the minimum oscillator frequency with resistor 852, wherein $$\text{Oscillator Frequency (Hz)} = 2.8E9/\text{Resistance 852 (ohms)}$$

Figure 10:
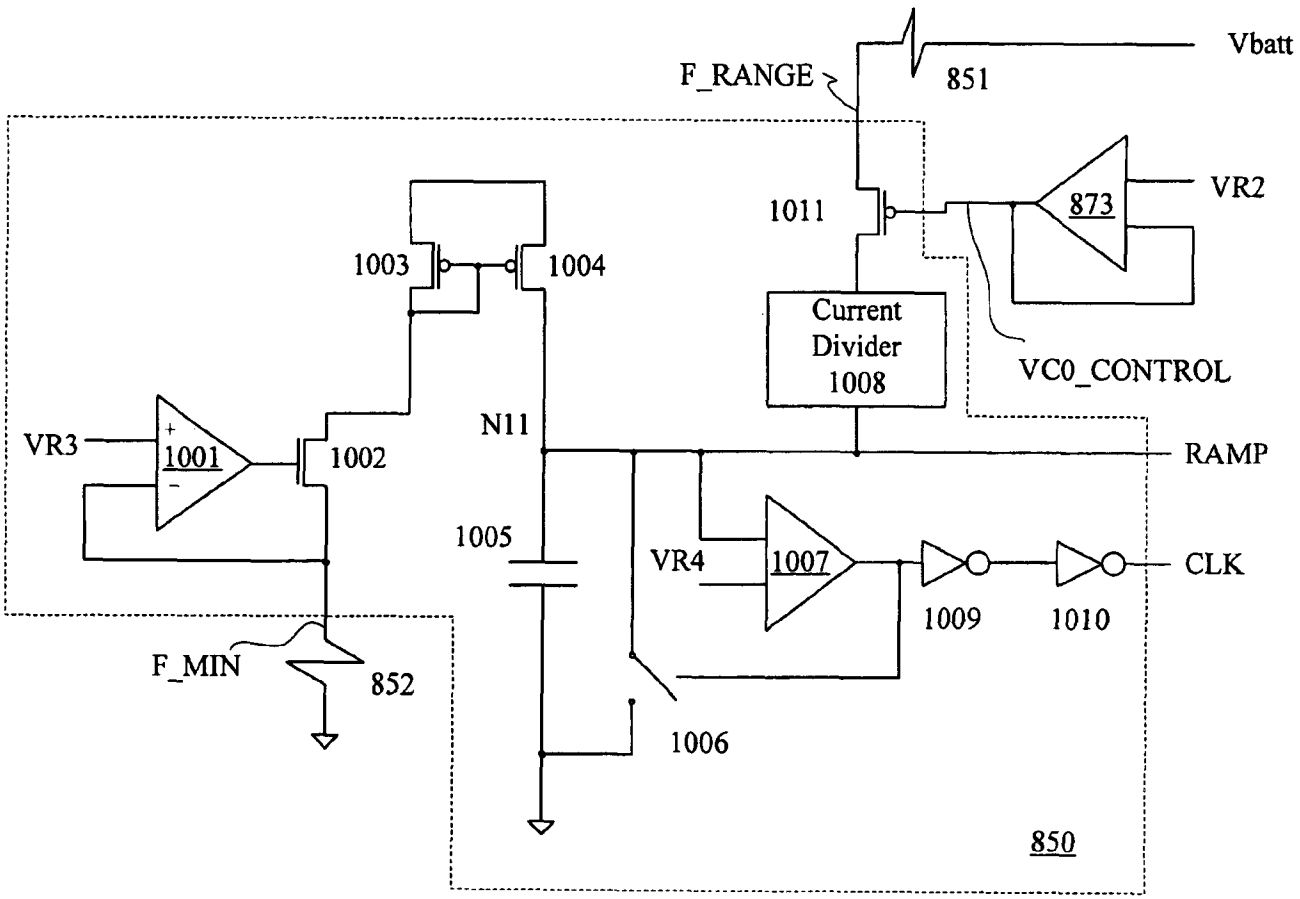
FIG. 10 illustrates a detail of the voltage-controlled oscillator (VCO).

A detail of VCO 850 is shown in FIG. 10. In this embodiment, VCO 850 includes a user-adjustable current source including an error amplifier 1001, resistor 852, and NMOS transistor 1002. Error amplifier 1001 is configured to receive a reference voltage VR3 and the signal at the source of NMOS transistor 1002. Error amplifier 1001 provides its output signal to the gate of NMOS transistor 1002. In this configuration, the current is equal to the reference voltage VR3 divided by the resistance of resistor 852. In one embodiment, reference voltage VR3 is approximately 1.5 V.

This current is then mirrored using PMOS transistors 1003 and 1004 onto a capacitor 1005. That current charges capacitor 1005, thereby increasing the voltage at node N11. Specifically, the voltage ramps up to a predetermined voltage determined by an error amplifier 1007, which receives the ramp voltage on node N11 and a reference voltage VR4. In one embodiment, the reference voltage VR4 can be approximately 3.0 V, thereby also setting the predetermined ramp voltage on node N11 to 3.0 V. When the voltage on node N4 reaches the predetermined voltage, error amplifier 1007 outputs a signal to close a switch 1006, thereby discharging capacitor 1005 to VSS (e.g. ground). Therefore, in this configuration, capacitor 1005, error amplifier 1007, and switch 1006 form a standard relaxation oscillator. Note that the output of error amplifier 1007 is also buffered using inverters 1009 and 1010 to provide the clock signal CLK. Further note that the ramping signal generated at node N11, i.e. signal RAMP, can be used to create the PWM signal (see comparator 853 in FIG. 8A).

In one embodiment, a current divider 1008, a PMOS transistor 1011, and error amplifier 873 can be used to add some current to node N11, thereby increasing the frequency of the RAMP signal. In this embodiment, error amplifier 873 is connected in unity gain, which will output a constant voltage substantially equal to reference voltage VR2. In one embodiment, reference voltage VR2 is approximately 1.25 V.

As the voltage Vbatt increases, more current flows across resistor 851 into current divider 1008. Resistor 851, which is coupled to battery 802, controls how much the oscillator frequency increases as a function of battery voltage (Vbatt). In one embodiment, resistor 851 has a resistance of 200 kohm. The relationship is:

$$\Delta\text{Frequency (Hz)}=3.44E8*(\text{Vbatt}-VR2)/\text{Resistance 851}$$

In one embodiment, current divider 1008 divides the current by a factor of 50, thereby ensuring the amount of current added to that already present on node N11 is quite small. Because the oscillator frequency can be adjusted upwards as the battery voltage increases, harmonic distortion of the output waveform can be advantageously minimized.

Third Control Block

The third control block adjusts the brightness by turning the lamp on and off at varying duty cycles. In this description, "dimming cycle" refers to the complete period including both an "on" and "off" states. At the end of each dimming cycle, the COMP pin is pulled low. At the beginning of a new dimming cycle, the COMP signal tries to increase quickly but it is clamped to the voltage at the SSV (soft-start voltage) pin. Capacitor 844, which is discharged at the end of every dimming cycle, sets the slew rate of the voltage at the SSV pin, and hence also the maximum positive slew rate of the COMP pin.

In one embodiment, a ramp generator 860 can generate a slow ramp voltage (i.e. a sawtooth waveform) that is limited by a small capacitor 861. In one embodiment, capacitor 861 has a capacitance of approximately 0.015 uF. A comparator 862 can compare this ramp voltage with a BRIGHT signal, e.g. a DC voltage provided by a user, which is proportional to the desired brightness. Based on this comparison, comparator 862 outputs a variable duty factor signal CHOP. Of importance, the CHOP signal can stop output driver 880 from switching, thereby stopping the OUTA signal by pulling it high. Signals OUTAPB and OUTC continue switching in order to allow the energy in the LC tank circuit to dissipate slowly without producing large voltages. As the voltage at the BRIGHT pin increases, the duty cycle of the dimming cycle (and the brightness of CCFL tube 805) increases.

The frequency of the dimming cycles is set by the value of capacitor 861 and is proportional to the current set by resistor 852 (which sets the minimum operating frequency of VCO 850). Setting capacitor 861 to 0.01 uF, resistor 852 to 47.5 kOhm, and VSS to ground yields a dimming cycle frequency of approximately 100 Hz. This frequency should vary inversely with the value of capacitor 861.

The brightness may also be controlled by using a variable resistor in place of resistor 807 (and 808). In this case, the BRIGHT pin should be pulled to VDD so that CCFL 811 runs at 100% duty cycle. Note that this configuration can result in some flicker at low intensities, but is otherwise functionally equivalent to the embodiment using resistor 807.

Start-Up Operations

In one embodiment, an SSC signal can be generated by alternative current sources. Specifically, two current sources, one at 1 uA and another at 150 uA, can be selectively connected to the SSC terminal of fault and control logic 870 as well as to one terminal of capacitor 871. Capacitor 871 has its other terminal connected to VSS. In one embodiment, capacitor 871 has a low capacitance of 0.022 uF.

During a "cold" start-up operation of CCFL 805, i.e. a start-up following a predetermined period of time in which CCFL 805 has been off, fault and control logic 870 generates an active signal FIRST, thereby selecting the lower value current source (i.e. 1 uA, in this embodiment). In contrast, during subsequent "warm" starts, i.e. a start-up following a time period less than the predetermined period of time, fault and control logic 870 generates an inactive signal FIRST, thereby selecting the higher value current source (i.e. 150 uA). In this manner, capacitor 871 takes longer to charge during a cold start-up than a warm start-up. The ramp generated by the SSC pin is used to define a time period when the fault detection circuity is disabled. Without this "blanking" interval the circuit would permanently shut down during every dimming cycle because of a misperceived fault. This operation is more fully explained in the fault circuitry description.

Exemplary Layout

Figure 8B:
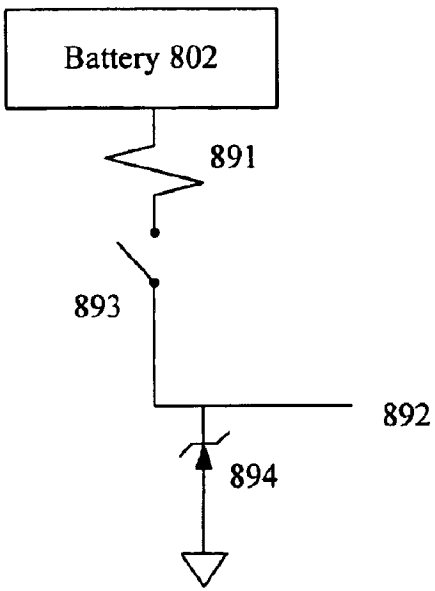
FIG. 8B illustrates one example of additional circuitry for generating the CE signal.
Figure 8C:
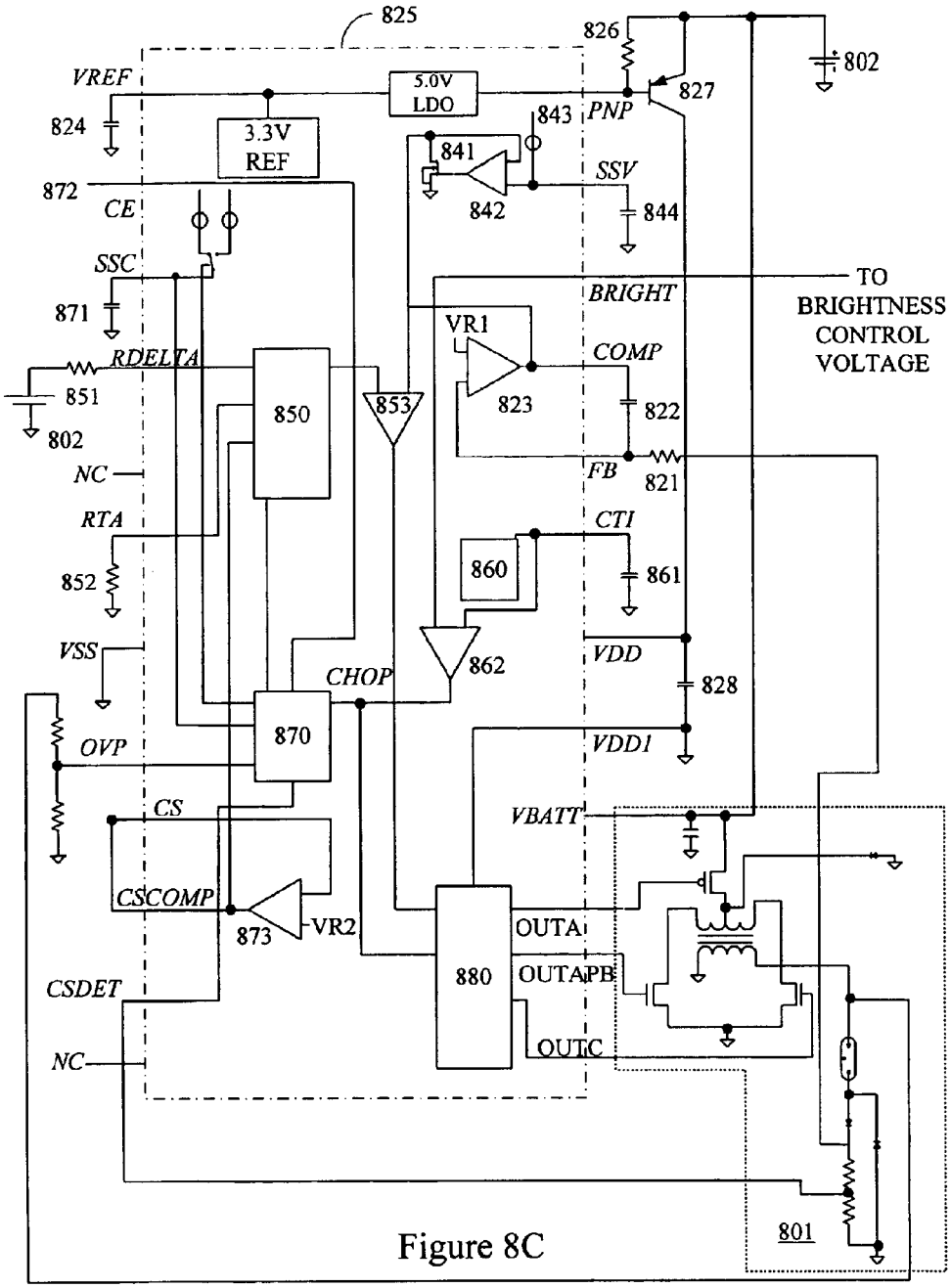
FIG. 8C illustrates one layout for the system of FIG. 8A.

FIG. 8C illustrates one layout for system 800 of FIG. 8A. Note that similar reference numerals denote similar components. Additional components can be included in system 800 as shown in FIG. 8C. Specifically, additional components can include, for example, resistor 826, a pnp transistor 827, as well as capacitors 824, 828, and 829. Capacitor 824, in one embodiment having a capacitance of 1 uF, functions to regulate the on-chip reference voltage (in one embodiment, 3.3V). Capacitor 828, pull-up resistor 826, and pnp transistor 827 form a linear regulator that can provide a VDD supply voltage (5V in one embodiment) from battery 802. In one embodiment, resistor 826 can provide a resistance of 2 kOhm, capacitor 828 can provide a capacitance of 4.7 uF, and pnp transistor 827 can provide a base-emitter voltage of 0.6V.

Capacitor 828, in this embodiment can serve as a bypass capacitor, which effectively supplies driver section 880 with large peaks of AC current necessary for switching the external mosfets 803, 804, and 816. In one embodiment, capacitor 829 can provide a capacitance of 4.7 uF. A dashed box 825 indicates that the components therein can be fabricated on one chip.

CCFL Circuit Operation

Referring to FIG. 8A, a PMOS transistor 803 drives the midpoint of the primary winding of transformer 814. The signal provided to the gate of PMOS transistor 803 is a pulse width modulated (PWM) signal that controls the current into the primary winding and by extension, controls the current in the CCFL tube 805. The drive signal of PMOS transistor 803 drives all the way up to the voltage provided by battery 802 and down to a predetermined voltage (in one embodiment, the predetermined voltage can be clamped at approximately 7.5 volts below the battery voltage). NMOS transistors 804 and 816 alternately connect the outside nodes of the primary winding to voltage VSS. These transistors are driven by a 50% duty cycle square wave at one-half the frequency of the drive signal applied to PMOS transistor 803.

Alternative Embodiments

Figure 9:
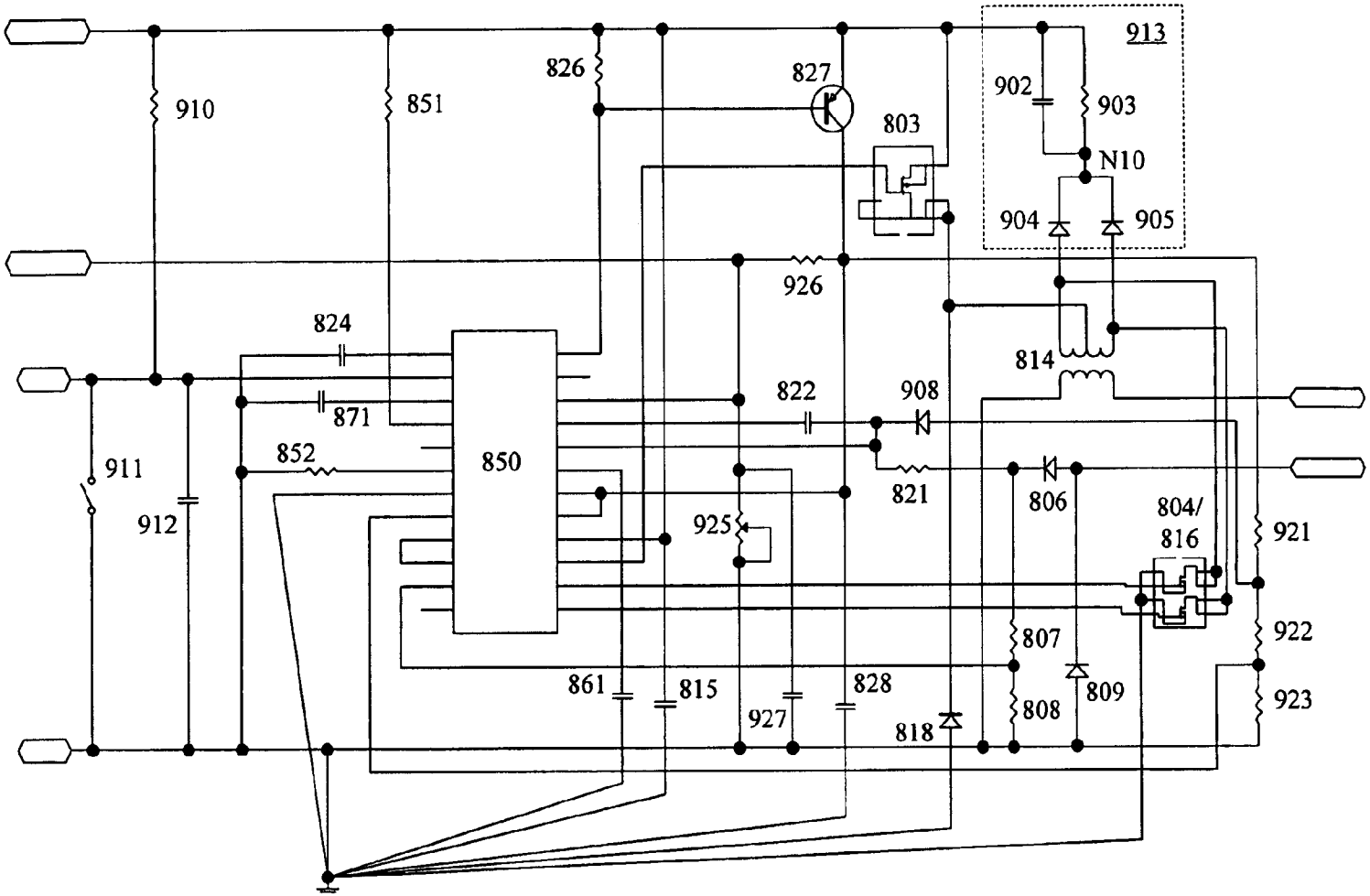
FIG. 9 illustrates another embodiment of a portion of the CCFL system including a snubbing circuit.

FIG. 9 illustrates another embodiment of a portion of the CCFL system. Like components in FIGS. 8A, 8C, and 9 are labeled identically. The embodiment of FIG. 9B includes a "snubbing" circuit, which comprises capacitor 902, resistor 903, diode 904, and diode 905. Its operation is described in the section entitled, "Circuitry For Minimizing Ringing". The embodiment of FIG. 9 also includes circuitry associated with the CE pin, i.e. resistor 910, switch 911, and capacitor 912 that many users might find convenient to turn the CCFL on and off by opening and closing switch 911. Note that the embodiment of FIG. 9 does not include capacitor 822, thereby significantly increasing the ramp up voltage at the SSV pin.

In the embodiment of FIG. 8A, resistors 810 and 811 can be used to sense over-voltages at the high potential side of the CCFL. The embodiment of FIG. 9 replaces resistors 810 and 811 with another voltage divider comprising resistors 921, 922, and 923. These resistors can essentially disable the OVP function by keeping the potential at the OVP pin lower than the OVP threshold (3 V) and higher than the under-voltage threshold (250 mV).

The embodiment of FIG. 9 further includes an adjustable resistor divider including resistors 925 and 926 as well as a capacitor 927. These components can be used to adjust the brightness of CCFL tube 811 (see FIG. 8A) by pulsing CCFL tube 811 on and off at a frequency much slower than the driving frequency of the transformer, but faster than the human eye can detect. For example, if the driving frequency of CCFL 805 is 50 kHz, then the dimming frequency might be 150–200 Hz.

Supply Voltages

In accordance with one embodiment, battery 802 can provide a voltage source between 7–24V (typical for 3 lithium ion cells provided in a notebook computer application). Most of the circuitry in system 800 can operate at a conventional voltage, e.g. 5 V. To this end, PNP transistor 827 can be used to provide a regulated VDD voltage from battery 802. Specifically, the PNP pin (see FIG. 8C) drives the base of PNP transistor 827, and the VDD pin is the VDD supply into the chip. In one embodiment, a 4.7 uF capacitor can bypass the VDD supply to ground. In this configuration, if an external VDD supply is available, then PNP transistor 827 would not be necessary and the PNP pin could float.

When the chip enable signal (CE) is low (e.g. less than 0.4 V), the chip goes into a zero current state. In one embodiment, the PNP pin can be put into a high impedance state, thereby reducing the VDD voltage to zero volts. The VDD voltage can be sensed internally so that the switching circuitry will not turn on unless the VDD voltage is larger than a first predetermined threshold voltage (e.g. 4.5 V) and the internal reference (e.g. 3.3V) is valid. Circuitry within the reference block is used to determine if the reference is close to regulation. Once it has been determined that the reference is close to regulation, the reference voltage can be used to determine if VDD is above a certain threshold voltage, e.g. 4.5V. In one embodiment, once the predetermined threshold has been reached, the switching circuitry will run until the VDD voltage is less than a second predetermined threshold voltage (e.g. 3.5 V).

Output Drivers

In one embodiment, the OUTAPB and OUTC pins are standard CMOS driver outputs. In contrast, in a preferred embodiment, the OUTA driver pulls up to the battery voltage, e.g. a maximum of 24 V, but is internally clamped to within 8 V of the battery voltage. On each signal transition for PMOS transistor 803, the OUTA pad will sink/source current (e.g. approximately 500 mA) for a short period of time (e.g. approximately 100 nS). After the initial burst of current, the current is scaled back (e.g. 1 mA for sinking and 12 mA for sourcing). This technique allows for fast edge transitions, yet minimizes overall power dissipation.

Fault Protection

In accordance with another feature of the present invention, fault condition checks can identify undesirable voltages provided associated with CCFL tube 805. When any one of the fault conditions is met, then CCFL circuit 801 is latched off. At this point, a power on reset or cycling the CE pin can restore CCFL circuit 801 to normal operation.

A first fault condition check identifies an over-voltage provided to CCFL tube 805. In this embodiment of system 800, resistors 811 and 810 are coupled between node N6 and VSS, thereby forming a voltage divider. In this configuration, a node N5 between resistors 811 and 810 provides an OVP signal proportional to the voltage across CCFL 805. Node N5 is connected to fault and control logic 870 via line 812. If the OVP signal (and thus CCFL voltage) is too high, then a long active CHOP signal generated by fault and control logic 870 can actually shut down CCFL circuit 801 to prevent potentially dangerous conditions from developing. In other words, if the voltage at node N6 is too high (e.g. 3 V), then fault and control logic 870 will turn off the chip regardless of the current operating mode.

A second fault condition check identifies an under-voltage provided to CCFL tube 805. Specifically, fault and control logic 870 can also check to see that there are no under-voltages at node N6. The second fault condition check can be used to ensure that the input voltage to CCFL tube 805 is above a predetermined voltage level on a cycle-by-cycle basis. In one embodiment, fault and control logic 870 is semi-disabled for a predetermined period of time after either a cold or warm start-up. Alternatively, this protection is disabled while the SSC ramp is below 3 V (which typically occurs during start-up and at the beginning of every dimming cycle). (Note that the first SSC ramp after power on reset (or CE enabled) can be 150 times slower than subsequent start up ramps.) After start-up, if the OVP pin does not cross a predetermined (e.g. 250 mV) threshold once during a certain number of (e.g. four) successive clock periods, then this fault will be identified. In this manner, fault and control logic 870 prevents an unwanted shutdown down due to a single spurious under-voltage event. After the semi-disabled time, fault and control logic 870 can again be fully enabled.

A third fault condition check can be used to monitor the current through CCFL tube 805. Specifically, to monitor the current, the voltage at node N4 can be checked. In one embodiment, the trigger voltage at node N4 is 250 mV. Fault and control logic 870 receives a CSDET signal from node N4. Thus, fault and control logic 870 can look for under-voltage conditions (tube under-current) at node N4. Once again, this fault check can be disabled for a certain period after each dimming cycle (similar to the under-voltage check of node N6). In one embodiment, fault and control logic 870 must receive four consecutive periods of under-voltage operation at node N4 before fault and control logic 870 generates a fault and shuts the chip down. Alternatively, this protection can be disabled while the SSC ramp is below 3 V.

Note that in one embodiment the resistor divider comprising resistors 810 and 811 (see also, resistors 922 and 923 in FIG. 9) can drive the OVP pin to a voltage above 250 mV but below 3 V, thereby effectively disabling the two fault condition checks relating to the voltage provided to CCFL tube 805 (i.e. the over- and under-voltage conditions at node N6). (Note that, in another embodiment, a capacitor divider (not shown) can be used to perform the same function as the voltage divider.) Of importance, the third fault condition relating to the current through CCFL tube 805 is usually sufficient to detect open circuit faults, which can be sufficient for some applications.

Figure 11:
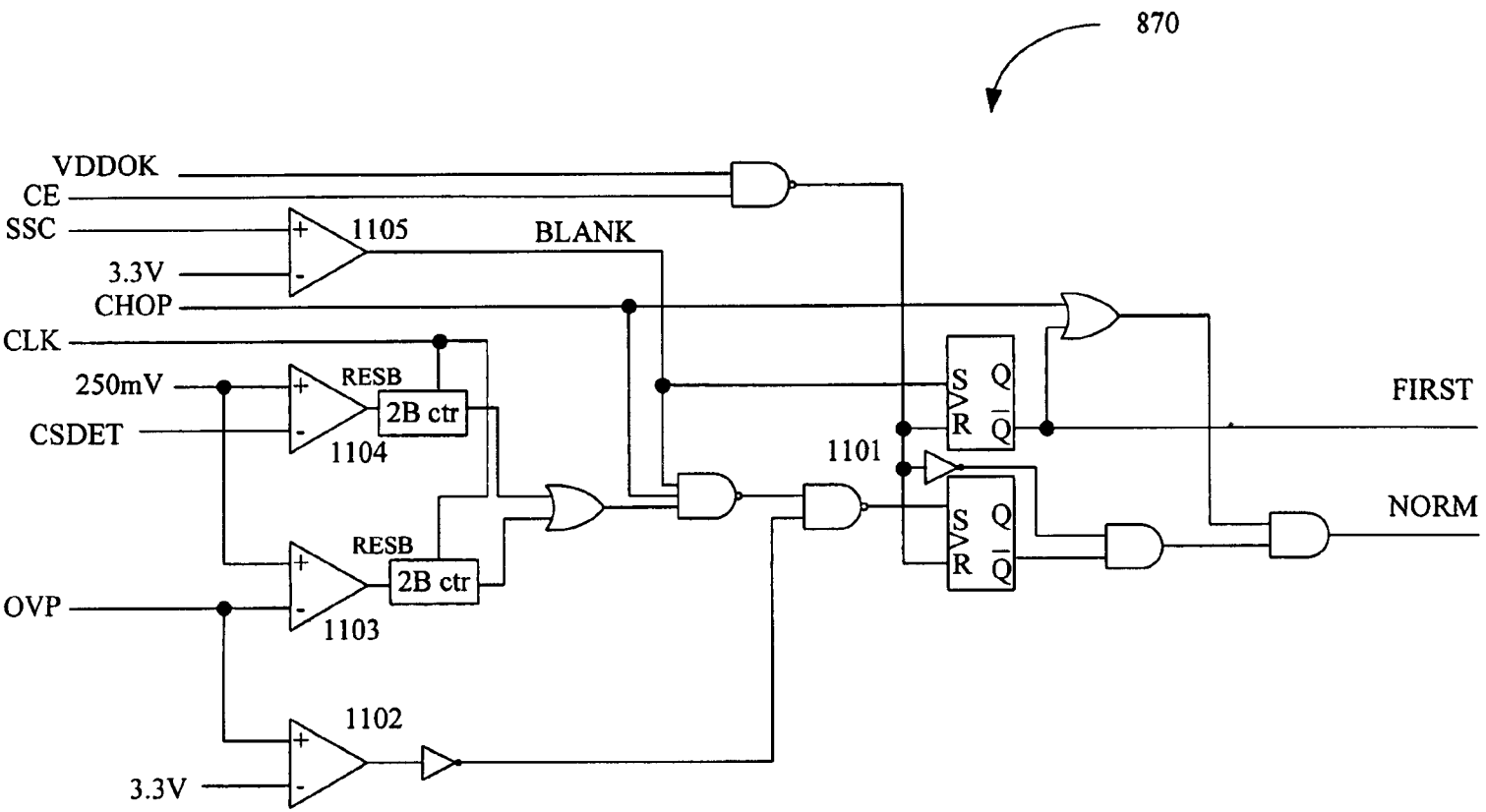
FIG. 11 illustrates one simplified schematic of the fault and control logic.

FIG. 11 illustrates one simplified schematic of fault and control logic 870. A signal VDDOK is generated by a circuit that detects if the VDD supply is within regulation. If the VDD supply is not within regulation, then VDDOK is a logic zero signal, thereby providing a logic one signal to the reset terminal R of the S-R flip-flops and an inverter 1101. This logic one signal forces the Qbar output terminal to a logic one and the output of inverter 1101 to a logic zero. This logic zero signal propagates through the subsequent logic gates as the NORM signal. A logic zero NORM signal deactivates output driver 880 (FIG. 8A), thereby preventing CCFL circuit 801 from operating if the VDD supply is not in regulation. NORM is low if a fault condition has occurred, during the "off" portion of burst mode dimming cycles, and when the chip is disabled. As described previously, the CHOP signal (generated by comparator 862) stops the operation of CCFL circuit 801 for burst mode brightness control.

The CLK signal is the clock output from VCO 850. The CLK signal provides the time base for the gate drive of the external FETs (like PMOS transistor 803). The OVP signal, which is generated at node N5 of CCFL circuit 801 (see FIG. 8A), is provided to two comparators, i.e. comparator 1102 for determining an over-voltage and comparator 1103 for determining an under-voltage. The CSDET signal, which is generated at node N4, is provided to a comparator 1104 for monitoring of the CCFL current. As previously mentioned, the under-voltage and the under-current conditions can trigger a fault if these conditions are presented a predetermined number of times. Hence, 2-bit counters can be coupled to the outputs of comparators 1103 and 1104, thereby facilitating the counting of successive under-voltage and under-current conditions.

The SSC signal, which is a capacitor-controlled voltage ramp available in system 800, and a reference voltage (in this case 3.3 V) are provided to a comparator 1105. In this configuration, the BLANK signal output by comparator 1105 is low while the SSC signal is below 3.3V, thereby effectively disabling the two fault checks associated with the 2 bit counters. Thus, the SSC signal can be used to provide a time delay during which two of the fault detection checks are disabled. Note that an output signal FIRST of fault and control logic 870 is high during the first dimming cycle after power is turned on, thereby causing the SSC pin to source significantly less current than on subsequent burst cycles. At the beginning of every dimming cycle, SSC starts at 0V and ramps linearly up to the VDD supply, however the first of these ramps after power up is 150 times slower than subsequent ramps.

Fault and control logic 870 also receives a chip enable CE signal (on line 872 in FIG. 8A), which can generate a power on reset condition as well as turning the CCFL on and off. FIG. 8B illustrates one example of circuitry for generating the CE signal. Specifically, battery 802 and a resistor 891 (for example, having a resistance of 1 MOhm) are selectively coupled to line 892 using a switch 893. Switch 893 can be activated by a microprocessor or a user-controlled switch (neither shown). A device 894 having zener diode characteristics (e.g. a nominal breakdown voltage of 3 V) is connected between line 892 and VSS, thereby limiting the voltage on line 892 after switch 893 is opened. Transitioning the CE signal from low to high has the same effect on the fault circuitry as a power on reset. Note that in FIG. 11 the CE signal and the VDDOK signal each drive one input of a two input NAND gate that is used to reset the RS flip-flops in the fault circuitry. When CE is low it has the same effect as if VDDOK is low. It resets Qbar of the "first" flip-flop to a "one" indicating that the current dimming cycle is the first dimming cycle after the power supply was disabled then enabled. It also reset Qbar of the "NORM" flip-flop to a "one" indicating that all faults have been cleared and normal operation may resume.

Arc Detection Circuitry

Typically, an over-voltage condition results when the impedance of the load increases above a predetermined level. Specifically, if the impedance goes too high, then the current sensed at the CSDET pin will fall below its threshold and circuit 801 will shut down. However, another problem occurs when CCFL tube 805 has poor contact to the rest of the circuit, i.e when a connector of CCFL tube 805 is not plugged in all the way.

In this case, the voltage generated by transformer 814 is so high that it can easily jump a 1 mm gap in air. Unfortunately, CCFL tube 805 will still operate in this condition, arcing across the open connector. If the connector is disconnected from CCFL tube 805 by a substantial distance (1 cm), then it is unlikely arcing will be a problem. If the connector is connected correctly there will also be no problem. However with a small gap in the connector (or anywhere in the high voltage power path) arcing can occur, thereby causing undesirable high temperatures in CCFL circuit 801. Therefore, over-voltage conditions caused by arcing should be detected as quickly as possible, and when detected, the circuit should be shut down.

As described above, an over-voltage condition can be sensed using a voltage (or capacitor) divider, which is coupled to the secondary winding of transformer 814 as well as CCFL tube 805. Unfortunately, this divider can change the AC characteristics of CCFL tube 805 and thus its resonant frequency. Moreover, the divider, by adding components, complicates the PC board layout.

Figure 12:
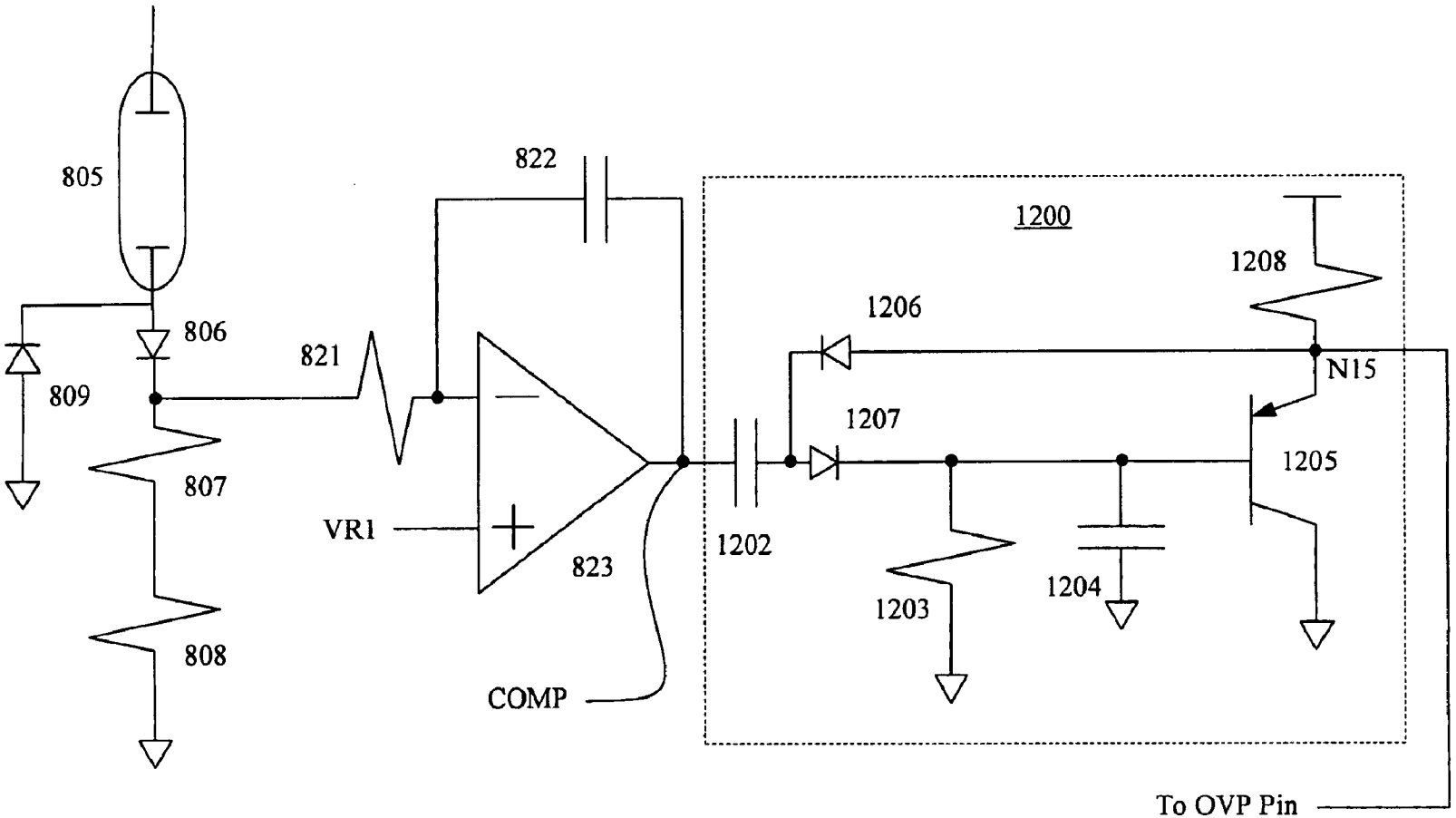
FIG. 12 illustrates an exemplary non-invasive circuit that can be provided to detect over-voltages provided to the CCFL circuit.

Therefore, in accordance with one embodiment of the invention shown in FIG. 12, a non-invasive circuit 1200 can be provided to detect over-voltages. In this embodiment, as described in reference to FIG. 8A, resistor 821, capacitor 822, and error amplifier 823 provide the normal integrating and feedback control for CCFL 805 (wherein like components in FIGS. 8A and 12 are labeled identically). The output of error amplifier 823 is the COMP signal.

Advantageously, circuit 1200 can generate the OVP signal, thereby eliminating the need for resistors 810 and 811 (FIG. 8A). Of importance, the resistive and capacitive components of circuit 1200 are isolated from the high voltage terminal of CCFL tube 805 (i.e. node N6). Having resistive and capacitive components exposed to such a high voltage can undesirably reduce current and energy through such components, thereby reducing efficiency. Moreover, the high voltage at node N6 can affect the impedance, thereby making voltage detection difficult.

In contrast to node N6, the COMP signal does not experience high voltages and typically does not vary significantly during normal circuit operation. For example, even during dimming cycles, the rise and fall of the COMP signal are smooth and relatively noise free. However, if arcing occurs, then the COMP signal becomes erratic as the circuit fights to stay in regulation.

Therefore, detection of this erratic behavior of the COMP signal can be used to shut the circuit down. In FIG. 12, the COMP signal can be coupled to diodes 1206 and 1207 through a capacitor 1202. Diodes 1206 and 1207 pump up the voltage at the base of a pnp transistor 1205, while a resistor 1203 tends to lower the base voltage of transistor 1205. If the COMP signal is moving erratically, then the pumping action of diodes 1206 and 1207 can overcome the leakage effect of resistor 1203 and the voltage at the base and emitter of transistor 1205 will increase. The voltage at node N15 can be provided to the OVP pin in the CCFL system, thereby indicating whether an over-voltage condition exists in the CCFL circuit.

Components of circuit 1200 operate in the following manner. Fast transitions (e.g. on the order of milliseconds) of the COMP signal are received by a capacitor 1202. A positive transition is passed through diode 1207 to the base of pnp transistor 1205. When the voltage at the base of pnp transistor 1205 increases so does the voltage on its emitter (which is coupled to a voltage VDD via a resistor 1208). A negative transition is blocked by diode 1207, but during this transition, diode 1206 conducts current from VDD through resistor 1208 into capacitor 1202. On the next positive transition, capacitor 1202 is charged up and is ready to supply current into the base of pnp transistor 1205. In this embodiment, resistor 1203 and a capacitor 1204 establish the time constant for the "fast" transition period. During a fast transition, the voltage at the emitter of pnp transistor 1205 will eventually increase to a point where it will trip the OVP threshold of the chip, thereby shutting down CFFL circuit 801 (FIG. 8A).

Figure 13:
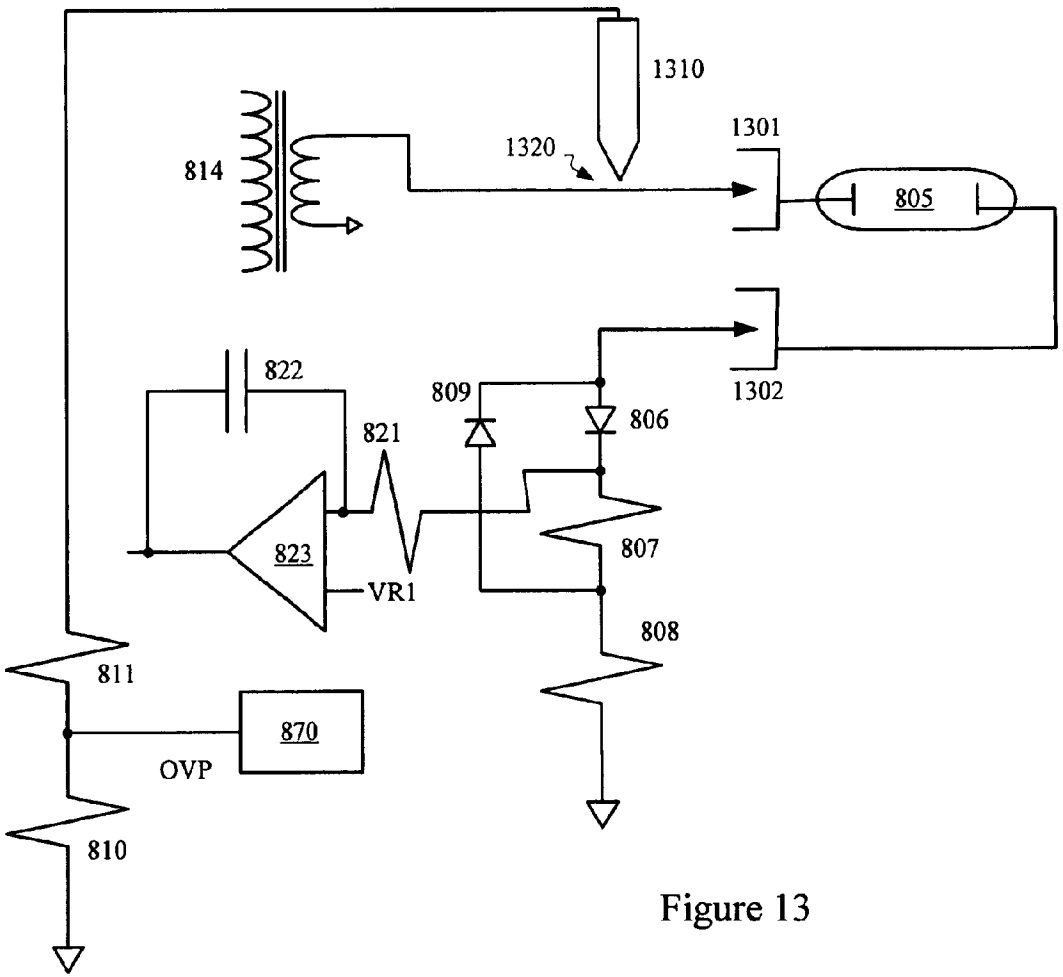
FIG. 13 illustrates a preferential arcing path that can be used for detecting and shutting down the CCFL circuit during arcing events.

Another method of detecting and shutting down the circuit during arcing events is to use a preferential arcing path. For example, in one embodiment shown in FIG. 13, a PCB trace 1310 can be brought very close (e.g. within 7–15 mils) to the high voltage connector 1301 of CCFL tube 805. In this configuration, if CCFL tube 805 is not properly seated using connectors 1301 and 1302 (1302 being the low voltage connector to CCFL tube 805), then a high voltage charge on connector 1301 will choose to jump across a gap 1320 to PCB trace 1310, thereby increasing the voltage on the OVP pin. When this voltage increases over a predetermined limit (e.g. 3 V), then CCFL circuit 801 is shut down.

Different operational characteristics could be achieved by modifying gap 1320 on the PC board and by opening the solder mask on the area between the preferential arcing node 1310 and connector 1301. As the preferential arcing gap 1320 between node 1310 and connector 1301 is made smaller the voltage at which arcing will occur is also smaller because the electric field between the two electrodes of the arcing path increases as the distance between those two electrodes decreases (assuming a constant potential difference between the two electrodes). Note that because gap 1320 to connector 1301 would have air as its dielectric, it is advantageous to use air as the dielectric for the preferential arcing path as well.

Circuitry For Minimizing Ringing

Due to the leakage inductances of transformer 814 (FIG. 8A), voltages at the drains of NMOS transistors 804 and 816 can potentially ring to values substantially higher than the ideal value (e.g. twice times the battery voltage). To limit the extent of the ringing voltage, the CCFL system can include a snubbing circuit 913, as shown in FIG. 9. In snubbing circuit 913, capacitor 902, resistor 903, and diodes 904 and 905 are configured to maintain a nominal voltage at their common node N10. In one embodiment, this nominal voltage is approximately twice the battery voltage. However, if either of the drains of NMOS transistors 804/816 ring above that voltage, then diodes 904 and 905 forward bias and allow the ringing energy to charge capacitor 902. Resistor 903 bleeds off the extra ringing energy, thereby preventing the voltage at common node N10 from increasing substantially higher than the nominal voltage. The extra power dissipation is:

$$P(\text{dissipated})=\text{Vbatt}^2/\text{Resistance (903)}$$

For example, assuming that resistor 903 has a resistance of 3.9 kOhm and the battery voltage is 15 V, then the power dissipation of snubbing circuit 913 would be 58 mW or approximately 1% of the total input power. Thus, the value of resistor 903 can be optimized for a particular application to minimize dissipated power.

Note that the amount of ringing is a strong function of the operating frequency. Therefore, a user can advantageously select an appropriate resistance for resistor 852 such that the oscillator frequency is near the resonant frequency of the transformer LC network.

Multiple Tube Drive Circuit

Current LCD monitors may require multiple CCFL tubes to provide the high intensity light necessary for their intended application. Unfortunately, simply paralleling tubes with a single larger transformer is not advisable because differences in the load characteristics of the tubes may cause large mismatches in tube current and subsequent early tube failure. Alternatively, a single controller, single transformer can be used for each CCFL tube in the application; however, the cost of this type of application would soon become prohibitive.

Figure 14:
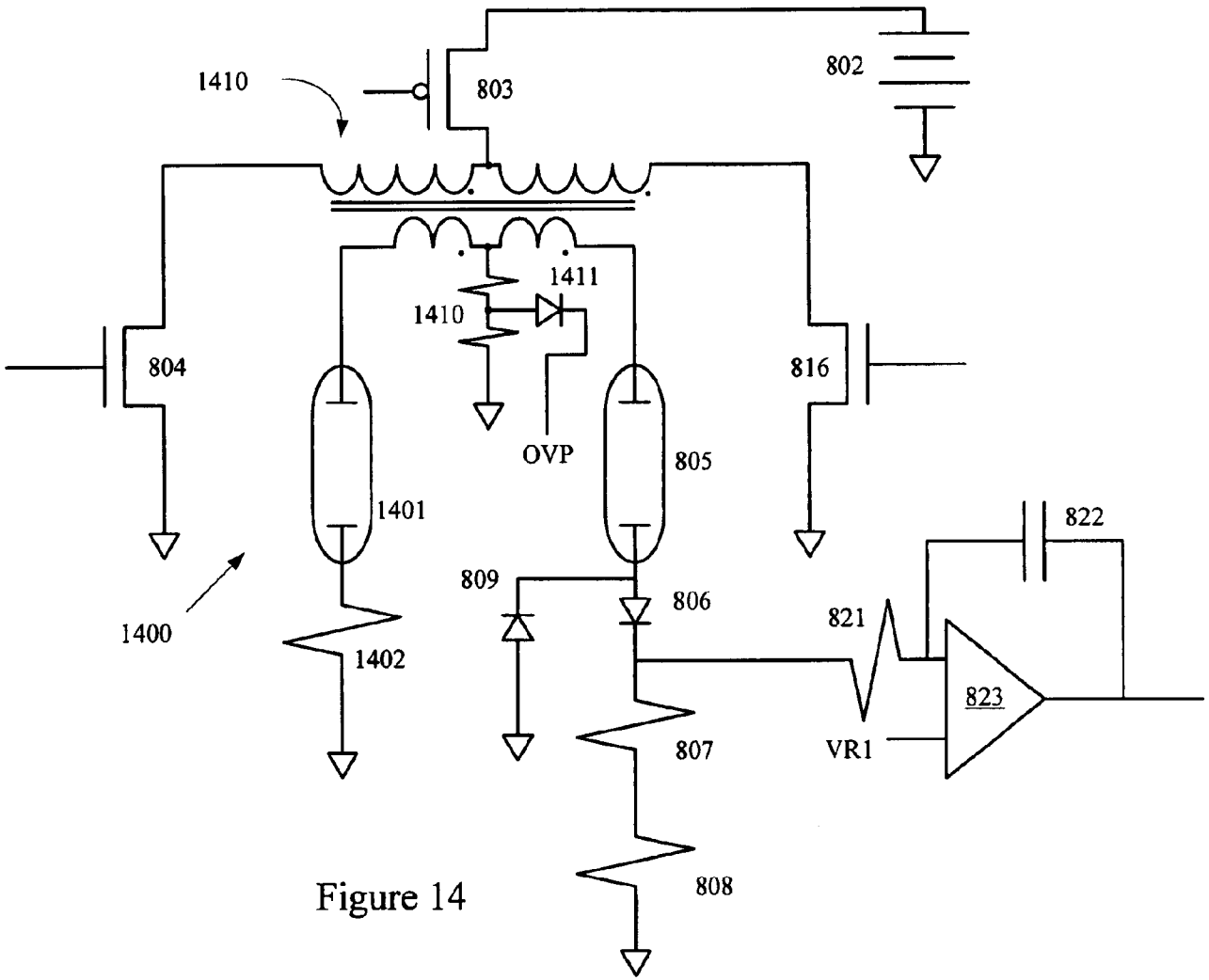
FIG. 14 illustrates a circuit that can drive two CCFL tubes in series.

FIG. 14 illustrates a circuit 1400 that can drive two CCFL tubes (i.e. CCFL tubes 805 and 1401) in series, but avoids the above pitfalls. Because CCFL tubes 805 and 1401 are in series their current should be substantially the same. Note that in an actual application, the parasitic capacitances can cause the tube currents to be unequal, thereby underscoring the need to match the parasitic paths as closely as possible.

In circuit 1400, the topology is substantially the same as for CCFL system 800 (see FIG. 8A). For example, the configuration and operation of PMOS transistor 803 and NMOS transistors 804 and 816 are identical to that in CCFL system 800. Moreover, the feedback loop for determining the current through CCFL tube 805 is identical to that in CCFL system 800. Note that the feedback loop need only be coupled to CCFL tube 805 because, as previously noted, the current in CCFL tube 1401 should be substantially identical to the current in the regulated tube, i.e. CCFL tube 805, as long as the parasitic capacitive paths are approximately equal for both tubes. A resistor 1402 can be sized to be substantially equal to the sum of the resistances of resistors 807 and 808, thereby ensuring that the impedances of CCFL tubes 805 and 1401 are equal.

Figure 15:
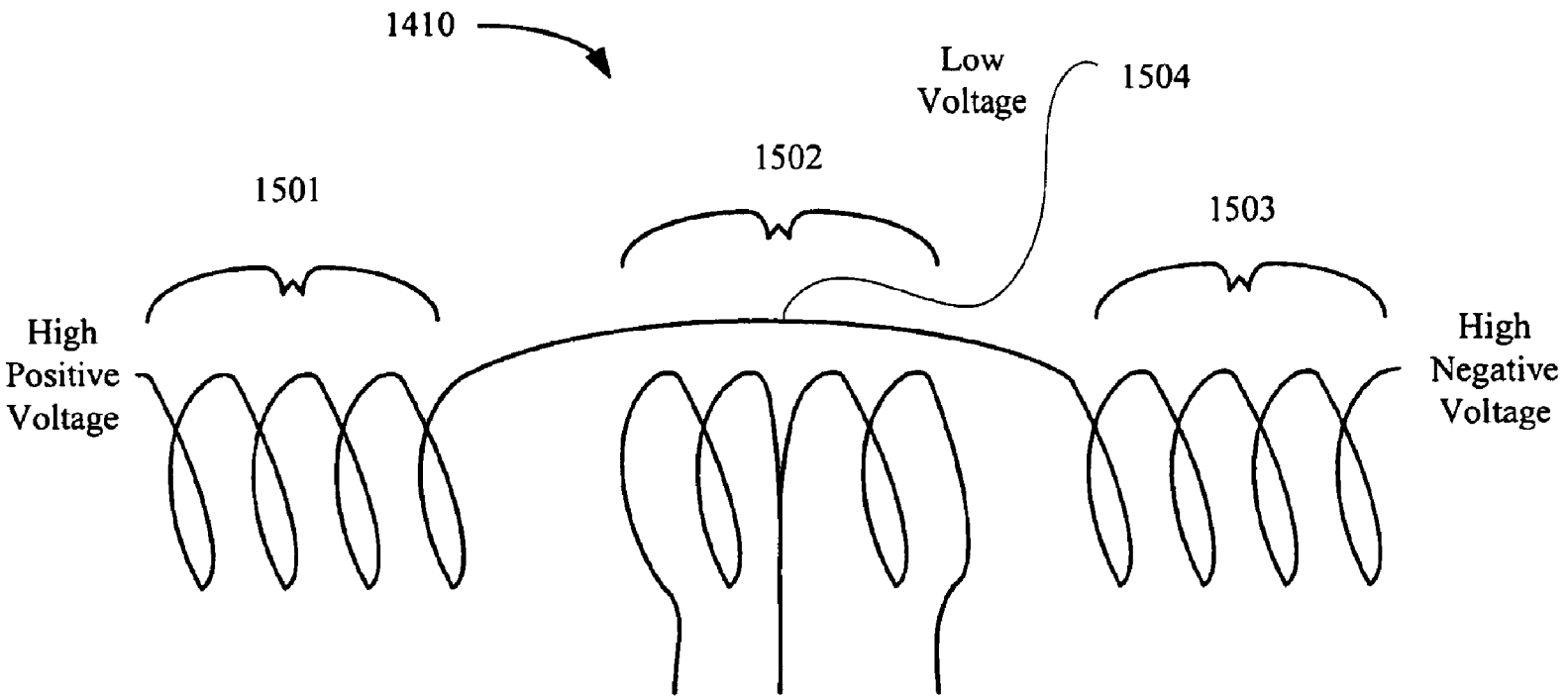
FIG. 15 illustrates the geometry of the modified transformer of FIG. 14.

The geometry of modified transformer 1410 is shown in greater detail in FIG. 15. In this geometry, a connection 1504, which is located between the two secondary windings 1501 and 1503, remains at a low voltage, e.g. ground. In contrast, the voltage outputs from secondary windings 1501 and 1502 are alternately a large positive voltage and a large negative voltage (e.g. +600 V and −600 V).

In one embodiment, connection 1504 is placed at approximately halfway between secondary windings 1501 and 1503. As long as the loads on the outputs of secondary windings 1501 and 1503 are substantially the same, this configuration eliminates the potential for arcing to occur between primary winding 1502 and secondary windings 1501 and 1503. Moreover, the highest voltages on the secondary windings occur as far away from each other as is possible, thereby also reducing the risk of arcing within the transformer.

Node 1504 is an ideal place to sense potential fault conditions caused by a missing tube or a marginal connection in the high voltage path where arcing may occur. For normal operation where the CCFL loads are approximately electrically equal the voltage at node 1504 remains close to ground. When a fault occurs in one of the secondary paths (such as a missing or broken CCFL) the voltage at node 1504 will deviate greatly from ground. By sensing the voltage at node 1504 through an appropriate resistor divider 1410 and rectifying diode 1411 (both shown in FIG. 14) a potentially dangerous fault can be detected before damage to the components has occurred. The rectified resistor divider voltage can be connected directly to the OVP pin of the control IC 825 (FIG. 8C). Resistor divider 1410 must be sized so that under normal operating conditions the rectified voltage at the output of diode 1411 is less than a predetermined threshold of a comparator at the OVP node of the control IC 825. Moreover, resistor divider 1410 must also be sized so that during a fault condition the voltage at the output of diode 1411 is higher than a predetermined threshold voltage of a comparator at the OVP pin of control IC 825. In one embodiment, the predetermined threshold is 3 volts. When the voltage at the OVP pin rises above the predetermined threshold, the chip shuts down as explained earlier in the discussion of the fault circuitry.

Figures 16A, 16B:
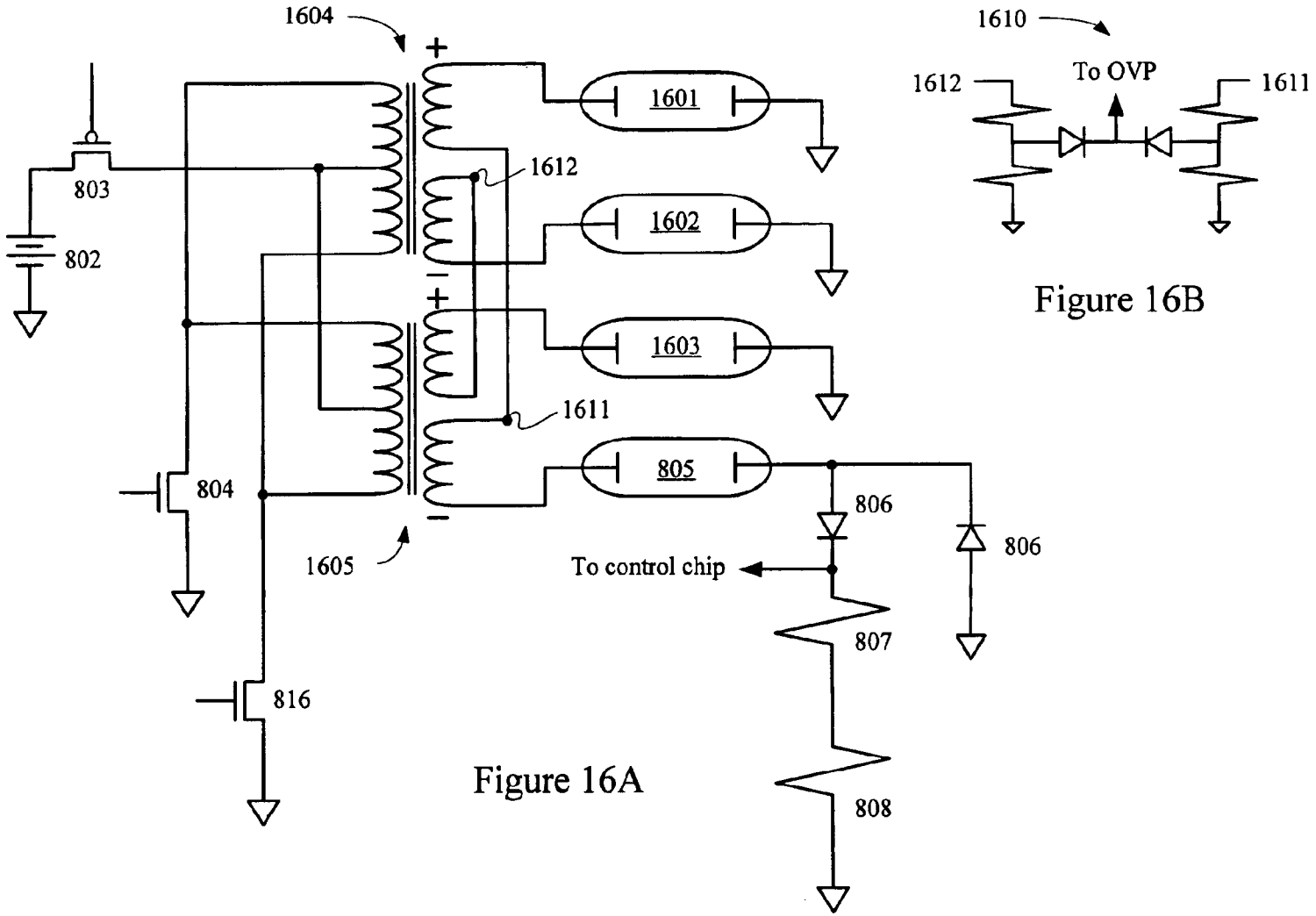
FIG. 16A shows a technique for driving 4 CCFL tubes.
FIG. 16B shows a sensing circuit for coupling to the CCFL configuration of FIG. 16A. The sensing circuit includes two diodes coupled to perform an OR function, thereby forming a composite OVP signal.

FIG. 16A shows the same technique for driving 2 tubes extended to 4 CCFL tubes 1601, 1602, 1603, and 805. In this embodiment, one control IC is used to drive 2 transformers 1604 and 1605, wherein transformer 1604 drives CCFL tubes 1601 and 1602 and transformer 1605 drives CCFL tubes 1603 and 805. Note that the secondary connections of transformers 1604 and 1605 are cross-coupled to equalize the currents through series connected pairs of 4 tubes. Because complementary pairs of tubes share the same transformer cores, the energy transferred to one pair of series connected tubes is largely the same as the energy transferred to the other pair of series connected tubes. If the CCFLs are similar to each other and the two transformers are also similar to each other, then the tube current through each tube can be substantially identical of importance, the control current is only sensed through one CCFL and therefore only one control chip is necessary.

FIG. 16B shows a sensing circuit 1610 for coupling to the CCFL configuration of FIG. 16A. Sensing circuit 1610 includes two resistor dividers and two diodes coupled to perform an OR function, thereby forming a composite OVP signal.

Figure 16D:
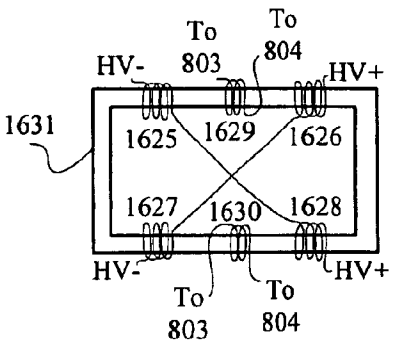
FIG. 16D illustrates an exemplary physical implementation of the schematic shown in FIG. 16C.
Figure 16C:
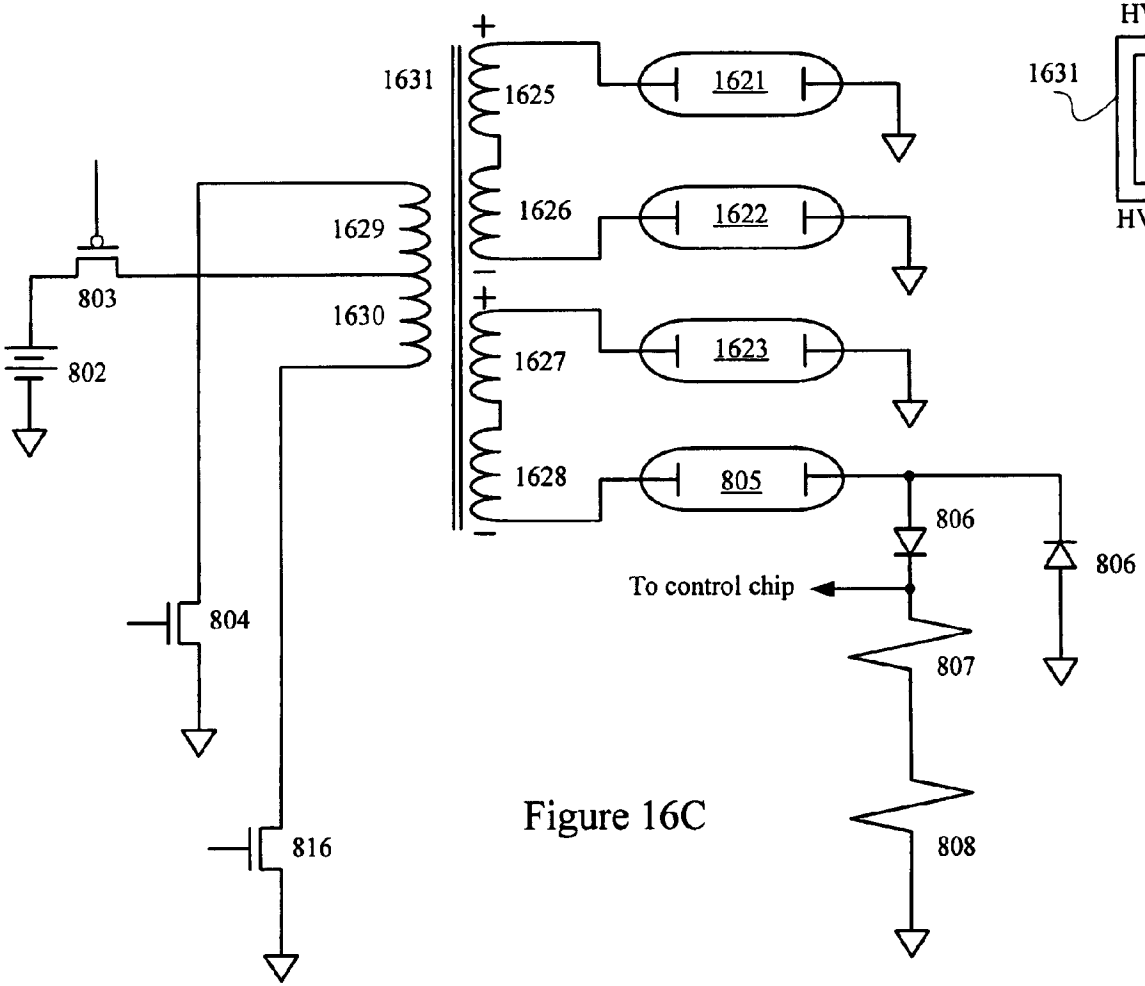
FIG. 16C illustrates another embodiment in which two primary coils as well as four secondary coils can be formed on one transformer core.

FIG. 16C illustrates another embodiment in which two primary coils 1629 and 1630 as well as four secondary coils 1625, 1626, 1627, and 1628 can be formed on one transformer core 1631. In this configuration, the transformer has a middle area, a first end, and a second end. Advantageously, a low AC voltage (e.g. VSS) can be provided in the middle area, a first high AC voltage having a first phase can be provided at the first end, a second high AC voltage having a second phase can be provided at the second end. Note that the midpoint of the secondary windings is positioned in the middle area. The AC voltage of the midpoint is naturally low compared with the AC voltage at the ends of the transformer. In one embodiment, the first phase is positive and the second phase is negative. The first end can include a first secondary winding and a second secondary winding providing first in-phase outputs, whereas the second end can include a third secondary winding and a fourth secondary winding providing second in-phase outputs. Of importance, the phase of the first in-phase outputs is out of phase with the second in-phase outputs.

FIG. 16D illustrates an exemplary physical implementation of the schematic shown in FIG. 16C. This configuration provides a lower cost and lower component count. Note that a sensing circuit, such as sensing circuit 1610, can be located at the common point of the two secondary windings (as is the case with two transformers).

FIG. 16E illustrates yet another embodiment in which two split primary coils 1641/1642 and 1643/1644 as well as secondary coils 1625, 1626, 1627, and 1628 can be formed on transformer core 1631. Note that split primary coils 1641/1642 and 1643/1644 can provide higher primary coupling than separate primary coils. FIG. 16F illustrates an exemplary physical implementation of the schematic shown in FIG. 16E. This tight coupling on the primary advantageously minimizes ringing. FIG. 16G shows a sensing circuit 1660 for coupling to the CCFL configuration of FIG. 16E. Sensing circuit 1660 includes two resistor dividers and two diodes coupled to perform an OR function, thereby forming a composite OVP signal.

Figure 17:
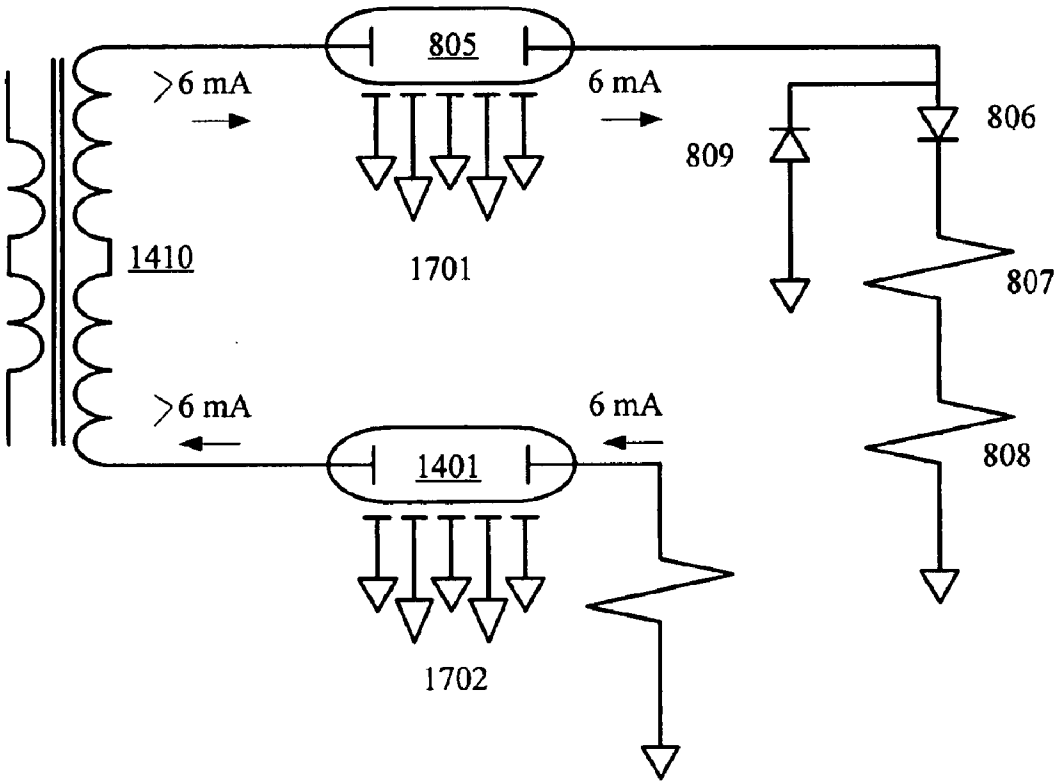
FIG. 17 illustrates the parasitic capacitive paths of the CCFL tubes in FIG. 14.

FIG. 17 illustrates the parasitic capacitive paths 1701 and 1702 of CCFL tubes 805 and 1401, respectively. Typically, current through CCFL tubes 805 and 1401 is lost due to coupling with the ground plane (via parasitic capacitive paths 1701 and 1702). Thus, for the current at sensing resistor 807 to be 6 mA (an exemplary value), the current at the other end of CCFL tube 805 (i.e. the end connected to transformer 1410) must be greater than 6 mA. Of importance, if parasitic capacitive paths 1601 and 1702 were different, then the overall tube current in CCFL tubes 805 and 1401 would be different. Over time and under such conditions, CCFL tubes 805 and 1401 might age differently. Specifically, their light outputs could be noticeably different or one tube might even be driven to premature failure due to over currents. Advantageously, in accordance with one embodiment of the invention, the parasitic capacitive current can be matched by placing both CCFL tubes 805 and 1401 on the same ground plane in the same manner.

Note that some components illustrated in various figures have been described as having exemplary resistances or capacitances. However, those skilled in the art will recognize that in other embodiments such components can have other values to modify performance outputs. Therefore, the present invention is not limited to the values of the disclosed embodiments.

What is claimed is:

1. A CCFL circuit comprising:

a PMOS transistor;

first and second NMOS transistors; and a high turns ratio transformer, wherein the transformer includes a primary coil having a center tap forming a first primary winding and a second primary winding, and a single secondary coil, wherein a drain of the PMOS transistor is connected to the center tap and the source of the PMOS transistor is connected to a battery, wherein a drain of the first NMOS transistor is connected to an end of the first primary winding, a drain of the second NMOS transistor is connected to an end of the second primary winding, and sources of the first and second NMOS transistors are connected to a voltage source VSS, wherein the first primary winding is tightly coupled to the second primary winding, and wherein the first and second primary windings are loosely coupled to the secondary coil, thereby resulting in significant leakage inductance; and a CCFL tube, wherein the secondary coil is connected between voltage source VSS and the CCFL tube.

2. The CCFL circuit of claim 1, further including a diode having an input terminal connected to voltage source VSS and an output terminal connected to the center tap of the primary coil.

3. The CCFL circuit of claim 1, wherein a primary to secondary turns ratio is approximately 100.

4. The CCFL circuit of claim 1, wherein a primary inductance is between approximately 150 uH and 250 uH.

5. The CCFL circuit of claim 1, further including a snubber circuit connected to the drains of the NMOS transistors, the source of the PMOS transistor, and the first and second primary windings.

6. The CCFL circuit of claim 5, wherein the snubber circuit includes first and second diodes, a capacitor, and a resistor, an input terminal of the first diode being connected to an end of the first primary winding, an input terminal of the second diode being connected to the end of the second primary winding, and output terminals of the first and second diodes being connected to a node, the resistor and the capacitor being connected in parallel between the node and the battery.

7. A CCFL system for driving first and second CCFL tubes, the CCFL system including:

a PMOS transistor;

first and second NMOS transistors; and a high turns ratio transformer, wherein the transformer includes a primary coil having a first center tap forming a first primary winding and a second primary winding, and a secondary coil having a second center tap forming a first secondary winding and a second secondary winding, wherein a drain of the PMOS transistor is connected to the first center tap and the source of the PMOS transistor is connected to a battery, wherein a drain of the first NMOS transistor is connected to an end of the first primary winding, a drain of the second NMOS transistor is connected to an end of the second primary winding, and sources of the first and second NMOS transistors are connected to a voltage source VSS, wherein the first primary winding is tightly coupled to the second primary winding, and wherein the first and second primary windings are loosely coupled to the secondary coil, thereby resulting in significant leakage inductance, and wherein the second center tap remains at a voltage near voltage source VSS during normal operation;

the first CCFL tube coupled between the first secondary winding and the voltage source VSS; and the second CCFL tube coupled between the second secondary winding and the voltage source VSS.

8. The CCFL system of claim 12, further including a feedback loop for determining the current through only the first CCFL tube.

9. The CCFL system of claim 7, further including:

at least a first resistor connected between the first CCFL tube and the voltage source VSS; and a second resistor connected between the second CCFL tube and the voltage source VSS, wherein the at least a first resistor and the second resistor provide substantially equal resistances, thereby ensuring that impedances of the first and second CCFL tubes are substantially equal.

10. The CCFL system of claim 7, wherein the ends of the first and second secondary windings provide a large positive voltage and a large negative voltage, respectively.

11. The CCFL system of claim 10, wherein the second center tap is placed at approximately halfway between the first and second secondary windings.

12. The CCFL system of claim 10, wherein if a fault occurs, then the second center tap provides a voltage substantially different from voltage source VSS.

13. The CCFL system of claim 12, further including:

a resistor divider connected to the second center tap; and a diode connected to the resistor divider.

14. A CCFL system for driving first, second, third, and fourth CCFL tubes, the CCFL system including:

a PMOS transistor;

first and second NMOS transistors;

a first high turns ratio transformer, wherein the first high turns ratio transformer includes a first primary coil having a first center tap forming a first primary winding and a second primary winding, and a first secondary coil having a first secondary winding and a second secondary winding;

a second high turns ratio transformer, wherein the second high turns ratio transformer includes a second primary coil having a second center tap forming a third primary winding and a fourth primary winding, and a second secondary coil having a third secondary winding and a fourth secondary winding, wherein a drain of the PMOS transistor is connected to the first and second center taps and the source of the PMOS transistor is connected to a battery, wherein a drain of the first NMOS transistor is connected to an end of the first primary winding and an end of the third primary winding, a drain of the second NMOS transistor is connected to an end of the second primary winding and an end of the fourth primary winding, and sources of the first and second NMOS transistors are connected to a voltage source VSS, wherein the first primary winding is tightly coupled to the second primary winding and the third primary winding is tightly coupled to the fourth primary winding, and wherein the first and second primary windings are loosely coupled to the first secondary coil and the third and fourth primary windings are loosely coupled to the second secondary coil, thereby resulting in significant leakage inductance;

the first CCFL tube coupled between the first secondary winding and the voltage source VSS;

the second CCFL tube coupled between the second secondary winding and the voltage source VSS;

the third CCFL tube coupled between the third secondary winding and the voltage source VSS; and the fourth CCFL tube coupled between the fourth secondary winding and the voltage source VSS, wherein the first and fourth secondary windings are connected and wound out of phase with each other, and wherein the second and third secondary winding are connected and wound out of phase with each other.

15. The CCFL system of claim 14, further including a current sensing network coupled to one of the first, second, third, and fourth CCFL tubes.

16. The CCFL system of claim 15, further including a fault circuit coupled to the second secondary winding and the third secondary winding.

17. The CCFL system of claim 16, wherein the fault circuit includes:

a first resistor divider;

a second resistor divider;

a first diode coupled to the first resistor divider; and a second diode coupled to the second resistor divider, wherein the first and second diodes are connected to provide a logic OR function to fault detection circuitry.

18. A method of determining a fault condition for a system including a transformer having a primary coil and a secondary coil, a first CCFL tube, and a second CCFL tube, the method including:

creating a tap in the secondary coil, thereby forming a first secondary winding and a second secondary winding;

connecting the first CCFL tube to an end of the first secondary winding;

connecting the second CCFL tube to an end of the second secondary winding; and determining the voltage at the tap.

19. The method of claim 18, wherein determining the voltage at the tap includes dividing and rectifying the voltage.

20. The method of claim 19, wherein dividing the voltage includes sizing a resistor divider so that:

under normal operating conditions, the rectified voltage is less than a first predetermined threshold voltage; and during a fault condition, the rectified voltage is higher than a second predetermined threshold voltage.

21. A CCFL system for driving first, second, third, and fourth CCFL tubes, the CCFL system including:

a PMOS transistor;

first and second NMOS transistors;

a high turns ratio transformer, wherein the high turns ratio transformer includes:

a primary coil having a center tap forming a first primary winding and a second primary winding;

a secondary coil having a first secondary winding, a second secondary winding, a third secondary winding, and a fourth secondary winding;

wherein a drain of the PMOS transistor is connected to the center tap and the source of the PMOS transistor is connected to a battery, wherein a drain of the first NMOS transistor is connected to an end of the first primary winding, a drain of the second NMOS transistor is connected to an end of the second primary winding, and sources of the first and second NMOS transistors are connected to a voltage source VSS, wherein the first primary winding is tightly coupled to the second primary winding, and wherein the first and second primary windings are loosely coupled to the first, second, third, and fourth secondary coils, thereby resulting in significant leakage inductance;

the first CCFL tube coupled between one end of the first secondary winding and the voltage source VSS;

the second CCFL tube coupled between one end of the second secondary winding and the voltage source VSS;

the third CCFL tube coupled between one end of the third secondary winding and the voltage source VSS; and the fourth CCFL tube coupled between one end of the fourth secondary winding and the voltage source VSS, wherein other ends of the first and second secondary windings are connected and wound out of phase with each other, and wherein other ends of the third and fourth secondary winding are connected and wound out of phase with each other.

22. The CCFL system of claim 21 further including a current sensing network coupled to one of the first, second, third, and fourth CCFL tubes.

23. A CCFL system for driving first, second, third, and fourth CCFL tubes, the CCFL system including:

a PMOS transistor;

first and second NMOS transistors;

a high turns ratio transformer, wherein the high turns ratio transformer includes:

a primary coil having a first center tap forming a first primary winding and a second primary winding and a second center tap forming a third primary winding and a fourth primary winding;

a secondary coil having a first secondary winding, a second secondary winding, a third secondary winding, and a fourth secondary winding;

wherein a drain of the PMOS transistor is connected to the first and second center taps and the source of the PMOS transistor is connected to a battery, wherein a drain of the first NMOS transistor is connected to an end of the first primary winding and an end of the third primary winding, a drain of the second NMOS transistor is connected to an end of the second primary winding and an end of the fourth primary winding, and sources of the first and second NMOS transistors are connected to a voltage source VSS, wherein the first primary winding is tightly coupled to the second primary winding, the third primary winding is tightly coupled to the fourth primary winding, the first and second primary windings are loosely coupled to the first and second secondary coils, and the third and fourth primary windings are loosely coupled to the third and fourth secondary windings, thereby resulting in significant leakage inductance;

the first CCFL tube coupled between one end of the first secondary winding and the voltage source VSS;

the second CCFL tube coupled between one end of the second secondary winding and the voltage source VSS;

the third CCFL tube coupled between one end of the third secondary winding and the voltage source VSS; and the fourth CCFL tube coupled between one end of the fourth secondary winding and the voltage source VSS, wherein other ends of the first and second secondary windings are connected and wound out of phase with each other, and wherein other ends of the third and fourth secondary winding are connected and wound out of phase with each other.

24. The CCFL system of claim 23 further including a current sensing network coupled to one of the first, second, third, and fourth CCFL tubes.

25. A method of physically implementing a transformer, the transformer having a core segment with a middle area, a first end area, and a second end area, the method comprising:

winding a primary coil around the core segment in the middle area;

winding a first secondary coil around the core segment in the first end area;

providing in the first secondary coil a first high AC voltage having a first phase at the first end area;

providing in the second secondary coil a second high AC voltage having a second phase at the second end area; and positioning the first and second secondary coils substantially equidistant from a midpoint is naturally low compared with the first and second high AC voltages, thereby preventing arcing between the primary coil, the first secondary coil, and the second secondary coil.

26. The method of claim 25, wherein the low AC voltage is VSS.

27. The method of claim 25, wherein the first phase is positive and the second phase is negative.

28. A method of implementing a transformer, the transformer having a middle area, a first end, and a second end, the method comprising:

providing a low AC voltage in the middle area;

providing a first high AC voltage having a first phase at the first end;

providing a second high AC voltage having a second phase at the second end; and positioning a midpoint of secondary windings proximate to the middle area, wherein an AC voltage at the midpoint is naturally low compared with the first and second high AC voltages, wherein the first end includes a first secondary winding and a second secondary winding providing first in-phase outputs, the second end includes a third secondary winding and a fourth secondary winding providing second in-phase outputs, the phase of the first in-phase outputs being out of phase with the second in-phase outputs.

* * * * *